US010582588B2

(12) United States Patent
Khosla et al.

(10) Patent No.: US 10,582,588 B2
(45) Date of Patent: Mar. 3, 2020

(54) CONTROL SYSTEM

(71) Applicants: Aarti Khosla, New Delhi (IN); Sanjeev Khosla, New Delhi (IN)

(72) Inventors: Aarti Khosla, New Delhi (IN); Sanjeev Khosla, New Delhi (IN)

( * ) Notice: Subject to any disclaimer, the term of this patent is extended or adjusted under 35 U.S.C. 154(b) by 88 days.

(21) Appl. No.: 15/566,800

(22) PCT Filed: Apr. 14, 2016

(86) PCT No.: PCT/IB2016/000466
§ 371 (c)(1),
(2) Date: Oct. 16, 2017

(87) PCT Pub. No.: WO2016/166591
PCT Pub. Date: Oct. 20, 2016

(65) Prior Publication Data

US 2019/0053350 A1 Feb. 14, 2019

(30) Foreign Application Priority Data

Apr. 15, 2015 (IN) ..... 1047/DEL/2015

(51) Int. Cl.
*G05F 1/00* (2006.01)
*H05B 37/02* (2006.01)
(Continued)

(52) U.S. Cl.
CPC ..... *H05B 33/0869* (2013.01); *H05B 33/0872* (2013.01)

(58) Field of Classification Search
None
See application file for complete search history.

(56) References Cited

U.S. PATENT DOCUMENTS

2007/0273290 A1 11/2007 Ashdown et al.
2012/0179421 A1 7/2012 Dasgupta
(Continued)

FOREIGN PATENT DOCUMENTS

EP 2687418 1/2014
IN 199890 9/2006

OTHER PUBLICATIONS

Kunifuji et al: "A Novel Railway Signal Control System Based on the Internet Technology and an Assurance Technology", Distributed Computing Systems Workshops, 2008. ICDCS '08. 28th International Conference on, IEEE, Piscataway, NJ, USA, Jun. 17, 2008 (Jun. 17, 2008), pp. 581-586, XP031290820, ISBN: 978-0-7695-3173-1.

(Continued)

*Primary Examiner* — Anh Q Tran
(74) *Attorney, Agent, or Firm* — Ladas & Parry LLP

(57) ABSTRACT

The present invention relates to an improved control system for use in applications requiring high level of functional integrity at one or more location, for improving efficiency, availability, reliability and safety of operation in various applications by segregating the domains of various functions critical to maintain high level of system operation integrity, remote networking and control, and transporting a proven, monitored function through a medium to another location and using the received proven function information to further prove the function at the receiving location with the functional identification of the receiving location, entire operation being online and/or periodically reciprocated/handshake/monitored.

39 Claims, 10 Drawing Sheets

(51) Int. Cl.

| | |
|---|---|
| ***H05B 39/04*** | (2006.01) |
| ***H05B 41/36*** | (2006.01) |
| ***H05B 33/08*** | (2020.01) |

(56) References Cited

U.S. PATENT DOCUMENTS

| | | | | |
|---|---|---|---|---|
| 2013/0147367 | A1* | 6/2013 | Cowburn ..... | H05B 37/0254<br>315/152 |
| 2014/0081473 | A1 | 3/2014 | Bengtson | |
| 2014/0111272 | A1 | 4/2014 | Fichtner et al. | |
| 2016/0081152 | A1 | 3/2016 | Zhang et al. | |

OTHER PUBLICATIONS

EP 2687418 _ English Abstract.

* cited by examiner

CONTROL SYSTEM

RELATED APPLICATION

This application is a national phase entry under 35 USC 371 of International Patent Application No.: PCT/IB2016/000466 filed on 14 Apr. 2016, which claims priority from Indian Application No. 1047/DEL/2015 filed on 15 Apr. 2015, the disclosures of which are incorporated in their entirety by reference herein.

FIELD OF THE INVENTION

The present invention relates to an improved control system for use in applications requiring high level of functional integrity at one or more locations. When operated on a product application said system causes improvement in efficiency, availability, reliability and safety of operation by segregating the domains of various functions critical to maintain high level of system operation integrity, remote networking & control, and transporting a proven, monitored function through a medium to another location. Said system uses the received proven function information to further prove the function at the receiving location with the functional requirements of the receiving location, entire operation being online and/or periodically reciprocated/handshaked.

BACKGROUND OF THE INVENTION

Railway signalling systems known in the art provide power supply in the control means with a filtration or rectification device particularly when the power supply is AC. LED being a DC driven device is also known to provide spike protection devices across the power supply line. While such devices have their uses, the use of such devices can itself result in unsafe conditions in the signalling circuits due to leakage, partial failure and the like. Leakage in such devices results in the current being drawn by the leakage resulting in the LED's not being lit, while simulating a lit up signal. LED signal lamps comprise of a cluster of LED's in series or parallel combination. Each series cluster may have an independent current regulator to prevent unequal current distribution through the cluster. However, without an overall feedback system, meaningful protection against failure is not feasible. It is known in the art to provide LED's in series combination with one or more shunts so that failure of one LED does not affect the other LED's in the cluster. However, this can result in reduction in the intensity of the beam. Also, in a condition where more than one LED has failed, a condition of poor visibility and/or unsafe conditions are created, since the shunts may be drawing current, but the LED cluster is not emitting adequate light.

Provision of a shunt by way of providing a parallel resistance across each series LED can be used to prevent failure of series of LED cluster in the event any one LED has failed in the unit. This, however, requires substantial power dissipation in the shunt resistances. This is further aggravated in the event the voltage jump allowable/cushion available is not substantial. Thermal control/dissipation means can be provided on LED lead/pad on the copper side of the printed circuit board/large copper area for each solder pad, for heat sinking to provide higher light output and improve temperature performance. However, the heat builds up in the enclosure over a period of time thereby affecting its performance.

A significant use of LED signal lamps is in the Railways which use high voltage traction where cables carrying drive to the lamps get induced voltage and may light up the signal when not intended to be lit. There can be a partial failure which may further lead to a complete failure. It is not desirable to have blanking of signals or unwanted signal lit.

LED signal lamps are desirable alternatives to filament bulbs used in signalling applications in order to reduce the maintenance, bulb fusing related problems as well as for lowering the energy costs. The use of LED's also enables the reduction in size of the signal housing. Another advantage of using LED's is that the use of secondary optics can also be avoided.

Reference is drawn to Indian Patent No. 199890 which discloses an architecture of the improved LED signal using Fail Safety device. However, this document does not provide the configuration of distinct domain arrangement of the control and monitored function as disclosed in the present invention.

US 20160081152 discloses generating a voltage feedback signal in non-isolated LED drivers, however, this document does not provide the configuration of distinct domain arrangement of the control and monitored function as disclosed in the present invention.

EP 2687418 discloses LED track signal for rail transport and interface for such an LED track signal, however, there is no disclosure of domain distinction method provided by this document.

None of the prior documents disclose sequencing of control and/or monitoring functions to improve the integrity, safety and reliability in the control system as disclosed in the present application.

A conventional LED based signalling system comprises a unit for supplying a signal. The signal supply unit provides either an ON signal or an OFF signal. In the presence of an ON signal, the aspect (which is comprised of a cluster of LEDs) is required to glow. In the presence of an OFF signal, the aspect should not glow. In one of the configurations, the absence of an ON signal can be considered as an OFF signal and similarly, vice versa. The signal from the signal supply unit is provided to the aspect (lighting unit) at location through a series of devices whose functionality is to detect failure in the proper operation of the aspect in indicating the appropriate signal.

More particularly, a first component identified as "Series Lamp Checking Relay (ECR)", a second component identified as "Health Monitoring Unit (HMU)" and a third component identified as "Current Regulator (CR)" are coupled between the signal supply unit and the aspect at location. The ECR comprises a series relay whose function is to validate presence of the appropriate signal in the line between the signal supply unit and HMU. If the appropriate signal is not present in this part of the line, the ECR should inform the signalling system.

It may be noted that in order to operate the ECR it is required to supply high level of current while to drive the LED current, substantially low level of current is required. Thus, to drive both the aspects at location and the ECR, a separate component identified as CR is used. As can be noticed, the CR comprises a LED driver circuit which supplies the appropriate driving supply to the aspect and comprises a relay driver load which is able to generate the suitable condition which upon detection by Line Proving Sensor (LPS) leads to triggering of the ECR.

The aspect at location comprises, at least, one optical feedback mechanism to determine as to whether the aspect is outputting the proper signal or not. By way of example, the relay driver load may be brought into action depending upon the output of the optical feedback mechanism.

However, in the above described system, there exists a possibility of not having a correspondence between the signal and the ECR during earthing, cable faults and other conditions.

Also, the power drop across the cable which is commonly referred to as cable drop is substantially very high (because of the high level of the current flowing through cable). Thus, the amount of energy spent is substantially high.

Also, induction of electrostatic field in the current carrying conductors is a difficulty in the commonly available system.

Thus, despite the above described improved versions of lamping system which use LEDs, it is still required to provide further systems which are more efficient and address at least some of the above drawbacks of the above identified systems.

In railway signalling, the signals are proven to operate them in an interlocked manner. In such cases, safety requirements also focus on:

- proving of the signal which is done by sensing its load which may lead to picking up of the Relay (ECR). Existence of a load without signal being lit is considered unsafe and this may lead to incorrect communication to the train driver.
- blanking of signal i.e. a signal meant to be lit but not lit can lead to disruption in Rail operation or missing of signal by the driver which is also unsafe.

The above conditions when translated to LED signals require:

- LED's may not fail as short circuit. Thus, reverse polarity or overdrive conditions are not safe.
- LED array (LEDs in series) may be more than one so that failure of any array does not lead to signal blanking.
- any protection or controls in the system must be stable with temperature variations.
- fail safety may lead to open circuit conditions or partial failure indication. It is not desirable that an aspect is lit when not selected or unlit aspect is proven as lit.

Current LED signals are a retro fitment in the bulb signal lighting circuit and are provided with blanking and non-blanking functions with latching, which was not there in bulb lit signals.

LED signals perform over a time span of 10 years as compared to bulb signals which have a time span of few months. This requires HMU for predictive maintenance. However, HMU is no longer kept in circuit due to fuse blowing caused by accidental shorts during maintenance work and the related work of setting it right.

The light output of a bulb is directly related to the current drawn. In bulb lit proving circuits, use of series current sensed lamp checking relay is suitable.

In LED signal the current is not directly related to the light output. Use of current sensed series ECR is not the desirable solution in this safety application. The current operated ECRs require far greater current than needed for the signal illumination by LEDs. However, this is mandated as the LED signals are retrofitted in existing signal circuits. Thus, though LED lighting requires only about 3W, the rest is dissipated in the unit.

The present LED signals are mostly AC lit, thus, they have AC noise immunity of about 60V through electronic cut-off, and thus require use of cutting-in relay circuit as a protection against false lighting due to induced voltage, adding to cost and affecting availability.

The present LED signals have limited protection ability to withstand extraneous voltage and would fail above 200 VAC (MOV of 175 VAC). In field conditions with over and above the 110 VAC used to light up the selected signal there can be additional induced AC voltage of 100 Volts/km. Thus, there can be conditions where the voltage applied to selected signal is enough to damage it. Many signals have been received from the field with input stage burnt.

The present LED signals are not immune to cable fault. A short in cable will lead to wrong side failure.

The signals internally operate on DC and being operated on AC supply requires the use of Bridge Rectifier and Filter Capacitor, MOV as devices across the line the failure of which can lead to wrong side failure.

The signal is proven at the signal post only and it is indirectly proven at the station by sensing the cable current which constitutes the signal current and any other leakage current in the cable. The specification requires that if the signal current, which may not be directly related to the signal illumination, is required to be operated in a certain window else the signal should be latched to blanking or non-blanking condition. Thus, any electrical disturbance to a steadily lit selected signal can cause it to latch and cause disruption in train operation. When a train is passing such electrical disturbances may be created, besides vibration/change in pressure of relay contacts in the field.

The degradation in LED illumination over the life span of the signal is a definite phenomena. In view of the above, it is preferable that since the original HMU is also not being used the lamp proving may not be based on current sensing only.

LED signal use electronic/electrical components. Dissipation in circuit should be minimized to improve reliability.

The LED signals use electronic circuits. The cable from cabin to signal is also an integral part of the lighting circuit. Lamp proving should be immune to cable faults.

Bulb lit signals are self-restoring and current LED signals are not.

The 2003 SSC (Signals Standards Committee) decided that non-dissipative LED main signals should be developed, and till such time the current regulator unit used should be a separate unit as it carries the dissipation of 80% of the power consumed and exceptional heating in the limited space available, which is not suitable for the LEDs and overall reliability of the product, cost of maintenance, inventory, etc. The proving/safety methods required use inhibiting functions like blanking and latching. It was seen as a limitation as compared to self-restoring fail safe filament bulb. Today, significant percentage of the failures of LED signals are due to blanking, non-blanking/latching, etc.

Present signals operating on LED ECR effectively load 22-25 W on the railway system per lit aspect including signal transformer, inverter, etc. losses. Signalling cables have AC leakage/induced current which can be as high as 40 ma after the use of cutting in relays. Thus, operating current of existing type of signal has to be kept quite high so that its normal functioning is not affected by leakage/induced AC current. This also increases the cable drop and reduces the signal distance. The inverter, signal transformer failure also contributes to signal failure.

Thus, to overcome the drawbacks of earlier systems, the present invention provides an improved control system for lamps with one or more driven unit, thereby improving efficiency, availability, reliability and safety of operation by facilitating reduction in energy consumption, capital costs, and maintenance costs in various systems operating and monitoring various electrical loads such as LED based lighting systems, logically integrating remote units, etc., by segregating the domains of various functions critical to maintain high level of system operation integrity and transporting a proven, monitored function through a medium to another location and for using the received proven function information to further prove the function at the receiving location with the functional requirements of the receiving location, entire operation being online and/or periodically reciprocated/handshaked which is further explained in detail herein below.

OBJECTS OF THE INVENTION

The object of the present invention is to provide an improved control system with high level of integrity for system operation monitoring, remote networking and control, improvement in reliability, availability and maintainability, simultaneously reducing costs, increasing energy efficiency and savings.

Another object of the present invention is to monitor a remote unit and to prove its status with high confidence level with respect to the terms of reference that it is or not operating as per the required condition.

Another object of the present invention is to logically integrate the units, sub-units and/or functions of the system in a sequence which improves the safety of operation in line with the objects of the invention and terms of reference thereby also reducing the need of the components and materials used.

Another objective of the present invention is to provide a distinct domain of the driven unit, power supply and that of the feedback to proving unit.

SUMMARY OF THE INVENTION

One of the main embodiment of the present invention relates to a control system for use in applications requiring high level of functional integrity at one or more location wherein:

- at least one unit (16, 17, 2,73,74,75) at the location is connected through one or more connecting medium (20, 27, 28) and
- at least one power source (11) is connected to the unit at the location
- the said at least one unit comprising sub units (23, 24, 25, 26) in any combination, the said system requiring at least one monitoring and control with one or more term of reference,
- wherein, the said at least one control function is in a different domain from at least the one monitoring function and/or another control function, and one or any unit/subunit (1, 2, 23, 24, 25, 26) of the system,
- and at least one sub unit (23, 24, 25, 26) in the unit (1, 2) is provided with a dedicated fail safety device (21, 21*a*).

Yet another embodiment of the present invention provides a system, wherein the subunits (23, 24, 25, 26) comprises of one or more in any combination, supply unit, proving unit, output unit and driven unit, at a location comprising of sub-components 29, 30, 32, 35, 38, 25 38*a*, 45, 46, 47, 49, 52, 59*a*, 61, fail safety device (21,21*a*), sensing means (31, 33), 39,41,42,51,56,64, 65,67 any conventional means.

Still another embodiment of the present invention provides a system, wherein the fail safety device comprises of Multiple feedback means (MFM), Under Over Control Means (UOM/UOCM), and any sensing means.

Still yet another embodiment of the present invention provides a system, wherein the control function comprises of activity to perform in accordance with the application for the end use with or without the conditionality of terms of reference.

Yet still another embodiment of the present invention provides a system, wherein the monitored function comprises of sensing feed back communication between the units, sub units, intra-sub units at the location and/or between the locations to perform the control functions.

Still another embodiment of the present invention provides a system, wherein in the said sensing means the outputs are combined such as optical sensing (42) and/or current sensing (41) are added by paralleling the outputs of different units/sub units at a location.

Yet still another embodiment of the present invention provides a system, wherein the sensing means may be selected from voltage sensing means AC-DC, AC or DC, current sensing means AC-DC or AC or DC, optical sensing means, thermal sensing means, magnetic sensing means or any type of conventional sensing means.

Another embodiment of the present invention provides a system, wherein the domain distinction between the control and monitored function is caused by transformation of energy form, re-transformation to the same energy form with isolation, encoding in the same energy form, polarising, limiting, changing levels, different energy forms, and alike, such that, the functional integrity, confidence level is achieved, on the same or different connecting mediums intra or inter location.

Still another embodiment of the present invention provides a system, wherein the supply unit (23), also comprises either alone or in combination the current limiting means (30, 46) and polarity control means (29).

Yet another embodiment of the present invention provides a system, wherein the proving unit (24) also comprises either alone or in combination, status or proving code generator (35), Multiple Feedback means (34), Under Over Control Means (33), any sensing means, status reader (32) and noise filter (45) for forwarding combined sensing and proving of monitored functions, outputs, inputs at supply and/or output unit.

Still another embodiment of the present invention provides a system, wherein the output unit (25) also comprises either alone or in combination sensing means, output status feeder/generator (59*a*), noise filter (60), multiple feedback means (40), under over control means output liming means (2*b*, 2*c*, 2*d*, 62) at least one power regulator (61) and optionally polarity control means (59).

Yet still another embodiment of the present invention provides a system, wherein said sensing means is preferably optical sensing (42, 64) and said optical sensing is formed by a plurality of tubes provided with photo-sensing device and a cup placed in series or parallel combination, the photo-sensing device used is an LDR, and/or phototransistor, and/or photodiode.

Still another embodiment of the present invention provides a system, wherein said feedback means (49, 61, 37) comprises a transformer to generate the DC signal power for the output, wherein the said feedback means comprises (52, 59*a*) comprises a transformer to feed, read AC signal power.

Another embodiment of the present invention provides a system, wherein the driving and/or proving of the driven unit/subunits is not in the domain of driven unit/subunit immunity.

Still another embodiment of the present invention provides a system, wherein the driven unit(s) (26) are kept in separate domain to provide immunity to false operation and is operated or controlled by the control system to achieve the application.

Yet still another embodiment of the present invention provides a system, wherein the power source (19) consists of a battery unit and optionally solar panel based battery unit at any location.

Still another embodiment of the present invention provides a system, wherein the output unit (25) and/or the proving units (24) are capable of transmitting telemetric and/or wireless signals to a remote location, and handshake any control and/or monitoring information of any unit and/or driven load in the system.

Yet still another embodiment of the present invention provides a system, wherein the telemetric signals are communicated to a remote location through a data logger and cable and/or wireless system (20, 27, 28).

Still another embodiment of the present invention provides a system, wherein all units of the system are connected through one or more than one mediums and will be interlocked with online handshake inherently validating the output of various sensing means for the high confidence level output with respect to the terms of reference, operation.

Yet another embodiment of the present invention provides a system, wherein the units, and the sub units within the units (1, 2, 23, 24, 25, 26) and sub components within the sub units are interconnected in functional priority sequence to logically preclude preferably the undesirable performance or failure, both in terms of systematic and/or functional failure of the unit/subunit (1, 2, 23, 24, 25, 26).

Still yet another embodiment of the present invention provides a system, wherein the sequencing of functions/sub functions is achieved by control of timing, physical connection, operating voltage/current/any form of input level/quantum control.

Another embodiment of the present invention provides a system, wherein the intra sub-units, sub components are any type of sensing means, coupling means, generating means, status reading means, status generating means, energy filter means, multiple feedback means, under over control means, audio and/or visual, alarm or any other conventional means or any combinations thereof.

Yet still another embodiment of the present invention provides a system, wherein a confidence of high level is proven for a key function to translate the same level of confidence to other functions proven based on the said key function, at the same or another location.

Still another embodiment of the present invention provides a system, wherein the power source (19) that provides the power supply which is either AC supply or DC supply that is to be used to energise the driven unit is superimposed with a code to change its domain from any other supply that may get applied to the driven unit (26), or another driven unit running on the same supply.

Yet still another embodiment of the present invention provides a system, wherein the system can be used in signalling system for railways, medical industry and such other areas to meet the safety & integrity requirements.

Further embodiment of the present invention provides a control system for providing reliable LED based signalling lamps based on optical feedback the said system comprising a supply unit (23), proving unit (24), output unit (25), and driven unit-LED cluster (26), wherein:

at least one power source (19) is connected to one or more supply unit (23), optionally, with one or more proving unit (24) on one side of one or more connecting medium (20) and one or more output unit (25) along with one or more driven unit (26) connected to the other side of the said one or more connecting medium (20);

said system requiring at least one monitoring and control function with one or more term of reference, and the said control function being in different domain from at least the one monitoring function, and one or any unit of the system, said LED being provided with a dedicated fail safety device (21) connected between said LED (2, 22) and the power source (19), and said plurality of LED cluster lamps (2) also being provided with an independent second fail safety device (21*a*) downline towards the power source (19), said independent second at least one fail safety device (21*a*) monitoring the status of at least one LED Cluster/lamp, the said optical feedback travelling on the signalling cable (20) feeding power supply to the output unit (25) being sensed at the station (1) in the proving unit (24) together with the selection supply Voltage at the supply unit (23) and current flowing out of the selection supply at the station (1) and generating a proving code to provide fail safe output to drive a common Relay (15, 48) as ECR wherein this output voltage constitutes a fail Safe output and can be used to interface with solid state interlocking (SSI).

Yet still another embodiment of the present invention provides a system, wherein the driven unit (26) comprises LED cluster lamps with or without optical sensing means and either alone or in combination control means, current limiting, current sensing means or any conventional means.

Still another embodiment of the present invention provides a system, wherein the said LED cluster (2, 26) is provided with active shunts (68, 69, 70) across each LED in the series arrays or part series array or complete LED array, so that upon an LED Failure there no complete failure Still another embodiment of the present invention provides a system, wherein the said LED cluster (2, 26) is provided with passive shunts (68, 69, 70) across each group/LED of LEDs in the series arrays, so that upon an LED Failure there no complete failure.

Still another embodiment of the present invention provides a system, wherein the supply unit (23) comprises either alone or in combination the current limiting means (30) and polarity control means (29) wherein the current limiting means (30) limits the flow of DC in one direction & polarity control means (29, 47) blocks the flow of AC in other direction and an inductor (47) impedes the flow of AC in both directions to ensure that the supply output (54) is DC even under induced AC conditions and thus the DC Output (54, 55) upon selection (18,6) acts as a selection (supply) code as well for a single LED cluster/Output unit driving the driven unit (26).

Yet still another embodiment of the present invention provides a system, wherein said LED cluster (2, 26) is formed by monoconic or biconic or smd LEDs, with or without additional optics/optical control.

Still another embodiment of the present invention provides a system, wherein the driven unit (26) comprises of redundancy and reliability, at least two LED Arrays each with independent current limiting means (2*b*, 2*c*, 2*d*, 62) so that failure of one current limit circuit will not affect other LED array.

Still another embodiment of the present invention provides a system, wherein the optical feedback/feedback is generated after individually validating the parameters of voltage, current, optical, and such other factors for correctness as per the defined requirements at the location/unit, logically generating the combined correctness in fail safe manner as the feedback signal of high integrity.

Further yet another embodiment of the present invention provides a method for providing reliable LED based signalling lamps based on optical feedback the said method comprising of controlling the system, by providing power source (19) for power supply from location to an output unit (25) on the signal post via a cable (20); and receiving power supply at the other end of the cable (20) on the signal post (2, 25) and providing a valid output to the LED cluster, and generating and transmitting a validated output status code indicative of the output via the same cable (20); and receiving the transmitted output status code at the location (1) and generating a proving code based on the output status code thus received along with the power supply of the station (1) and its voltage and current parameters sensed, wherein:

at least one power source (19) is connected to one or more supply unit (23), optionally, with one or more proving unit (24) on one side of one or more connecting medium (20) and one or more output unit (25) along with one or more driven unit (26) connected to the other side of the said one or more connecting medium (20);

said system requiring at least one monitoring and control function with one or more term of reference, and the said control function being in different domain from at least the one monitoring function, and one or any unit of the system, said LED being provided with a dedicated fail safety device (21) connected between said LED (22) and the power source (19), and said plurality of LED cluster lamps also being provided with an independent second fail safety device (21*a*) downline towards the power source (19), said independent second fail safety device (21*a*) monitoring the status of one or more of lamps (2, 26, 16,16*a*, 16*b*, 16*c*, 16*d*, 16*e*,16*f*,16*g*,16*h*), the said optical feedback travelling on the same signalling cable (20) feeding power supply to the output unit (25), being sensed at the location (1) in the proving unit together with the selection supply voltage, at the supply unit (23) and current flowing out of the selection supply at the station (1) and generating a proving code to provide fail safe output to drive a common relay (48,15) as ECR wherein this output voltage constitutes a Fail Safe Output and can be used to interface with Solid State Interlocking (SSI).

Still another embodiment of the present invention provides a method, wherein said location (1) is a station or a relay room and/or a locomotive connected through another medium.

Yet another embodiment of the present invention provides a method, wherein at least one more proving is generated for the same output status code (59) and/or at least one more output status code is generated from the same proving code using the same medium or another medium at the same or another location.

Still another embodiment of the present invention provides a method, wherein the status code of the lamp on signal post (2) is generated by the output unit (25) after it is checked in inherently fail safe manner using under over control means and multiple feedback means (66) in functional priority sequence using optical sensing (64), voltage sensing (67) and current sensing means (65) wherein all functions are ANDed.

Yet another embodiment of the present invention provides a method, wherein, status code is the LED Lamp feedback (59*a*) and proving code is the output generated by the proving unit (24).

Still yet another embodiment of the present invention provides a method, wherein, the monitoring function inter unit/subunit and/or intra unit/sub unit is in a separate domain from the one or any other monitoring function.

BRIEF DESCRIPTION OF THE ACCOMPANYING DRAWINGS

The present invention is illustrated by way of accompanying drawings/figures which should not be construed to limit the scope of the present invention. The brief description of drawings are as follows:

FIG. 1 shows typical signal lighting circuit wiring as per the present invention FIG. 2(*a*) shows conventional LED Signal/Lighting Unit product FIG. 2(*b*) shows an architecture of the LED signal/Lighting Unit, system using fail safety devices on two ends of a connecting medium.

FIGS. 3(*a*) and 3(*b*) shows block diagrams comprising components and sub-components illustrating the present invention for a railway signal.

DETAILED DESCRIPTION OF THE INVENTION

Figure 1:
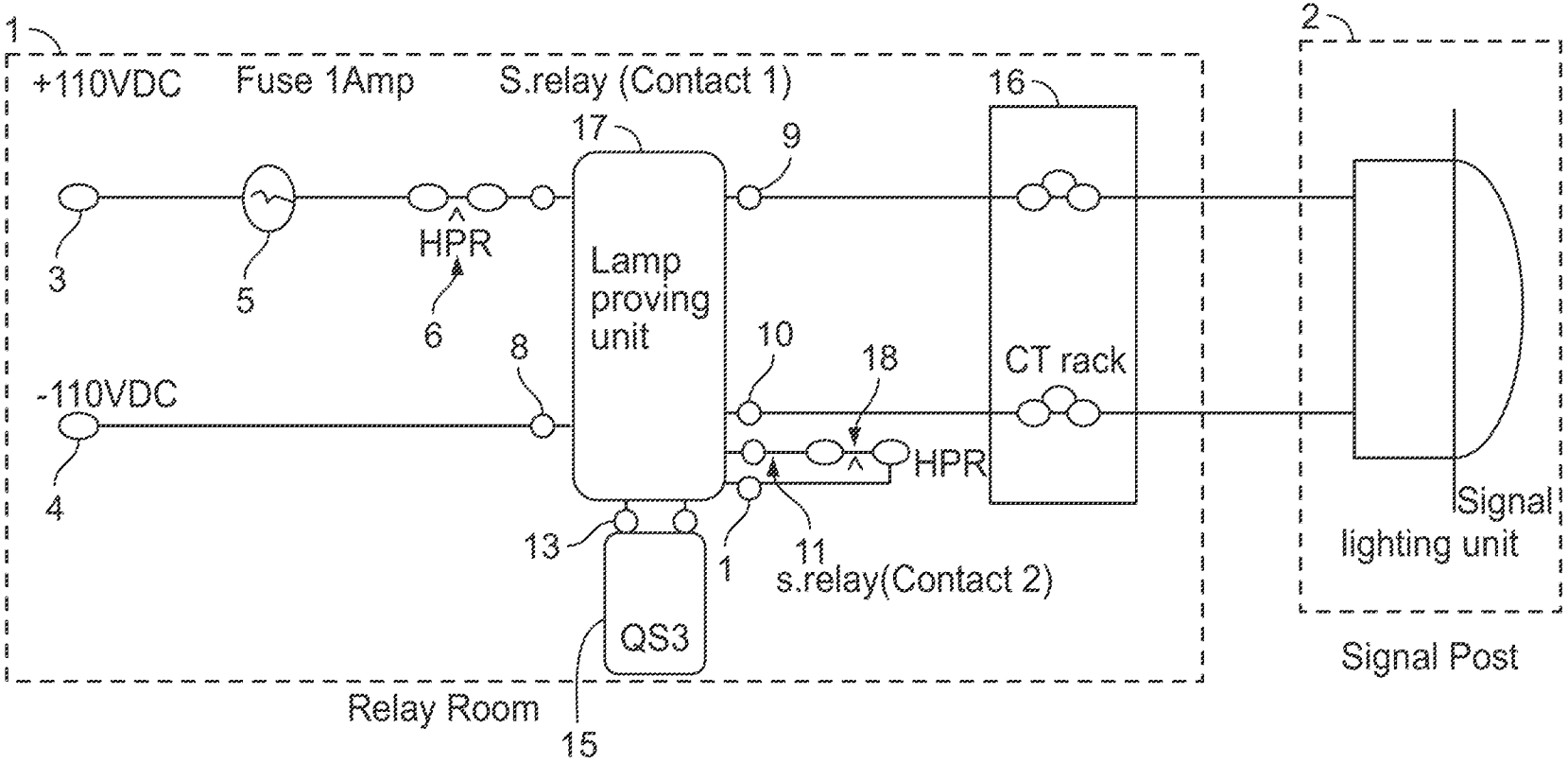

The present invention relates to an improved control system and is illustrated for signalling lamp systems with one or more driven unit comprising of plurality of LED cluster lamps, said system comprising at least one power source, connected to at least one supply unit optionally with at least one proving unit on one side of at least one connecting medium, at least one output unit connected to at least one driven unit connected to the other side of the said at least one connecting medium, the system requiring at least one monitored and/or control function with at least one term of reference, the said function being in different domain from the at least one monitored, wherein one or any unit of the said improved control system may consist of driven unit consisting of LED cluster lamp, but is not restricted only to LED cluster lamp.

Some of the terms such as "terms of reference", "monitoring and control function", "Driven Unit driving" "Driven Unit Immunity" are explained herein for better understanding of the invention.

"Terms of Reference" for a product are its end use boundary conditions which may not be violated under normal operation or in failure conditions. These can be defined quantitatively and/or qualitatively. For example, current shall not exceed "xy" under any conditions, the unit will not fail causing "A" & "B" to be in opposite phase, under no circumstances will the signal selected and fed with power, but not lit, will be proven as lit i.e., the lamp proving should only show a signal is lit when it is actually lit. In signalling systems, if an unlit signal is proven at station as lit it is called wrong side failure (WSF). Therefore, signalling systems require that there should be negligible possibility of WSF else train which is moving on signals only can have an accident. Similar conditions would be there for rockets and such other safety systems. So the invention of fail safety device is related to its use with respect to terms of reference of the application system. In order to achieve the terms of reference of any application which require UOCM, MFM and various sensing means, the fail safety device has to be used.

The "monitoring function" pertains to the monitoring of the specified working parameter and "control function" pertains to the ensuring of the specified working parameters to be maintained/controlled in specified range/window.

"Driven Unit Driving" pertains to energy form, used to drive the driven unit. For example, if electrical energy is used it can be DC or AC in a particular bandwidth or frequency, similarly for other forms of energy such as magnetic, light energy or such other forms of energies could be of specific colour and level intensity.

The phrase "Driven Unit Immunity" means driven unit operates on a particular form/manner/value of energy and its immunity pertains to anything other than which may appear/deemed interference to which it is required that it should not respond.

"Connecting Medium" can be air or vacuum or liquid or metal conductor, optical fibre or any of which can carry electrical, radio, magnetic, optical or any form of energy, encoded or otherwise as per the requirement of the function like driving/communicating, etc., in any combination to meet with the requirements of the application, facilitating interconnectivity between the functional elements of the product as per the terms of reference/functional requirements at a location or at different location. It is desirable that the medium should be used in a manner that the integrity of the function is maintained.

With respect to "Domain" as indicated in the product, while the driving of the LED signal at signal post is done from the station using a pair of conductors using DC, the status feedback of the signal is sent to the station using the same pair of cables using AC of 5 khz, generated with isolated output i.e. DC to magnetic and magnetic to AC energy transformation. Hence, it is not the same domain as the DC on the same cable and is also not in the same domain as the induced AC from the overhead traction. This driving DC, status feedback and induced AC (external AC to which immunity is required), all are in separate domains though on the same medium i.e. the cable. Basically, when electrical energy is used for "a" type of function and magnetic energy is used for "b" type of function one can easily see they are in different domains. However, while one medium is used then the form of energy in that medium has to be the same, which means electrical energy through cable. This combined with sensing through sensors which are designed only to respond to the specific domains provides immunity to ensure the integrity of the respective functions/operating requirement.

If the same medium is used for two functions i.e., supplying power, by connecting power supply on one side and on other side the unit connected receives the power connection and also to confirm that the power is coming from the source which is meant to light it up, a code is superimposed on the power supply, which then adds a selection function and the receiving unit having the decoding capability will then only light up when the supply is coming from the specified source. In other words, if any power supply is wrongly connected due to fault or mischief it will not light up the unit.

In railways, the cables carrying power supply where high voltage (25 kV) overhead supply is in use (called RE area), all the electrical cables underground get induced voltage as high as 95V/km 50 Hz. Thus, signal which is lit using AC 50 Hz supply can light up even when not meant to be, due to, induced voltage under cable fault conditions. If the power supply meant to be coming from the supply unit to DC instead of AC is changed and the output unit on the other side of the cable is such that it responds only to DC and not AC, for example, using voltage sensing means which responds only to DC & not AC as disclosed in this invention, the driven unit will have immunity to AC induced voltage which is one of the required terms of reference also requiring that it will light up only when selected, wherein the reliability can be further improved by adding energy filters to filter out the unwanted factors and also save energy. Therefore, while the medium is same the immunity function domain is AC power and signal lighting power domain is DC. Further, the appearance of DC while AC may or may not be there, itself acts as a selection code as well. Another term of reference here would be that the driven unit will not light up unless selected through the nominated supply unit connected at the other end of the medium which is electrical cable, in this case (Supply Selection Integrity). It is pertinent to mention here that DC can neither be induced nor can leak through the inter-conductor line capacitance unlike AC which suffers on both accounts. Thus, DC can appear only if physically connected. Where higher level of integrity in selection to lighting up of the unit is required, the DC power is supplied with code with a reader on the other side.

In case of a DC supply acting as the selection code as well with reader being a DC only voltage sensing means and also giving power to the driven unit through the output unit, it is required that if the signal is lit as per the defined requirements (Driven unit is operating as per the defined conditions) then status code from the driven unit, status proving done at the output unit side, done using various sensing means ate the output unit, will be received at another remote location, in this case, the supply unit side and the proving output shall be generated at the other end of the cable with local validation to ascertain that it is the cause and affect of the particular supply unit and not a false code which then complies to the term of reference here that "if the selected unit is lit as per the defined conditions then the proving unit output will also be affirmative and vice versa, as otherwise, it is unsafe operating condition.

So first the fail-safe status proving is done using MFM, UOCM with reference to all the parameters of various sensing means, such as, electrical current, optical output, etc. in different domains as per requirement, of the driven unit/s at the output unit and the output status code is transmitted after isolating its form of energy, changing its domain, by converting its electrical proving output of the MFM to magnetic energy and then transforming the magnetic energy back into electrical transmission energy, thereby isolating it from the original power source whose energy has been fed from the supply unit on the same electrical conductor medium, i.e. the same cable, the code being another electrical signal of substantially higher frequency such as 5 kHz than the AC of 50 hz, which can be easily filtered out and identified at the supply unit side in the proving unit, thereby changing the domain of the status code from the induced voltage immunity domain on the same medium. Thus, three functions are available on the same medium operating in different domains, one DC, other 50 Hz induced AC to which the system is immune, and status code transmission in AC of 5 khz.

The other necessary condition for fail safe operation of the above functions i.e. power supply for the driven unit, status code transmission and proving function correspondence should have isolated power sources, i.e., they do not electrically interfere, thus, the same medium is used for conducting different electrical functions in different domains to maintain high level of system integrity with respect to the terms of reference and are not affected by the induced AC voltage.

Such system is further immune to cable earthing faults. Thus, if one of the conductor gets earthed since the power source connected and/or coming out of the supply unit is isolated, and so is the status code transmitted, their energies are not affected by the earthing. Thus, they maintain their identities as well as there is no energy loss.

It is pertinent to mention here that proving, validation of functions relevant to the sub units, elements of the system is done at each location to maintain high level of system integrity with reference to the terms of reference.

In yet another requirement as the proving of the driven units status is already done at their location, and status code is received at the supply unit at location whose power is used to drive the driven units in this case, the status code can be also transmitted to at least one another location through at least one, second medium, wherein, it has its own supply unit and proving unit to meet with the terms of reference and functionality at the at least one such another location. This is possible because of the of the proving of driven units with high level of integrity also termed as fail safe or having negligible possibility of wrong side failure/proving.

In yet another requirement, if the same cable to light up one of the driven units at a time out of three colours RED, Yellow & green is used, the same cable is used to superimpose a distinct code of the driven unit on the power supply as per selection to light up only the selected driven unit and also ensuring that the power supply coming on the cable (medium) is genuine.

The said status code generator also operates on an audio visual alarm, where required. The present invention of an improved control system is described illustratively with driven units comprising LED cluster lamps with plurality of LEDs optionally with over protection means. Each LED cluster (driven unit) is provided with active shunts across each LED in the series arrays. Each LED cluster lamp is provided with a dedicated fail safety device. Said fail safety device is connected between LED and the power source. Plurality of LED cluster lamps as needed in a configuration are also provided with an independent second fail safety device downline towards the power source. The independent second fail safety device monitors the status of a plurality of lamps.

The over and under means of each said fail safety device is optionally provided with a dedicated audio and/or visual alarm.

The optical sensing means, formed by a plurality of opaque tubes is provided with photo sensing device and a cup, being non-opaque cup placed in series and or parallel combination. The photo sensing means is light dependant resistance provided on a printed circuit board forming the base of the LED cluster assembly so as to not interfere with the light intensity in the normal viewing path. The sensing means is provided on the housing cover in the dark portion of the LED signal lamp. The LED cluster assembly is formed by monoconic or biconic or smd LED's with or without optical control.

The domain being different form of energy and/or same form of energy with encoding and/or same form of energy with isolation, and/or energy converted to a different form by transforming a parameter of energy or any combination there wherein driven Unit driving is not in the domain of driven unit immunity with respect to the terms of reference. A monitored function in the electrical system and driving of the driven unit are kept in separate domain to achieve high level of system operation integrity.

All units of the system connected through one or more than one medium/s will be interlocked with online handshake inherently validating the output of various sensing means for the high confidence level output with respect to the terms of reference.

The interconnectivity of the units and the sub units within the units is done in functional priority sequence to logically preclude the wrong side failure both in terms of systematic failure and unit failures.

Inherently fail safe methodology is adopted to prove the key function, thereby facilitating the other functions to be determined through logical means with high degree of confidence level.

The sub units are any type of sensing means, coupling means, generating means, status reading means, multiple feedback means, under over control means or any other conventional means and any combination thereof.

The driven unit is a LED cluster with or without optical sensing and/or control means and/or current limiting and/current sensing means and/or any conventional means one or many and in any combination thereof. The driven unit is in a separate compartment.

The improved control system comprises of one or many power sources.

The inherently fail safe methodology is adopted to prove the key function, thereby facilitating the other functions to be determined through logical means with high degree of confidence level.

- proving is not done in DC, therefore, the components failure does not lead to any wrong side failure
- lamp proving at signal to be transported in fail safe manner to station & loco
- lamp proving is done at station online with signal on track
- lamp proving is done in loco online with signal on track
- If aspect is not lit lamp checking relay cannot be picked up, in other words, the proving mechanism will not show that the aspect is lit.
- lamp driving is in a different domain to lamp immunity requirement thus DC driven units are in different domain and immune to induced AC In the method provided by the present invention for True AC immunity of the LED Signal the system is lit with DC voltage. The signal will not then respond to Induced AC voltage. Change of lighting domain to DC also becomes a distinct selection code in the electrified area where the induced AC in the cables used to extend the power to the remote signal on the track, from the power source at the station, also carry induced AC from the 25 kV overhead Traction supply.

Further, a code is sent to the driven device and it operates on the local power source or changes state upon receipt or absence of code, and thereby cable to connect the signal/driven device to remote power source is not used and thus possibility of induction in the cable is removed. Thus, here the code used for lighting the signal is in a different domain from the power source.

Further the AC supply or DC supply which is to be used to energise the driven unit is superimposed with a code to change its domain from any other supply that may get applied to the driven unit. Thus, driven unit will be energised only with the supply which is carrying a code which it can decode.

Further, proving of a monitored function in the electrical system and driving of the driven unit are kept in separate domain to achieve high level of system operation integrity.

When a remote unit is to be monitored and it is to be proven with high confidence level with respect to the terms of reference, that it is or not operating as per the requirement, the domain of the driven unit power supply and that of the feedback to proving unit are distinct, thereby, ensuring that a fault in the system causing undesirable condition would not affect the assessment through the proving unit with respect to the terms of reference. Illustratively, this is explained by way of an example in case of a Track mounted LED signal which is lit by DC supply fed from the station at a distance and the cable is passing through R/E (Electrified) area where induced voltage from 25 Kv traction supply, is abundantly caused in the cable conductors carrying the supply, i.e. the need for protection from induced AC immunity is prevalent. DC lit signal as explained in the present invention is in a different domain from Induced AC, hence shall provide the requisite immunity. In order to prove at the station in accordance to the terms of reference that if signal is not lit the proving unit will have negligible possibility of showing it otherwise.

Architecture of the LED Signal [FIGS. 1, 2, 3, 4 and 5]

Figure 2A:
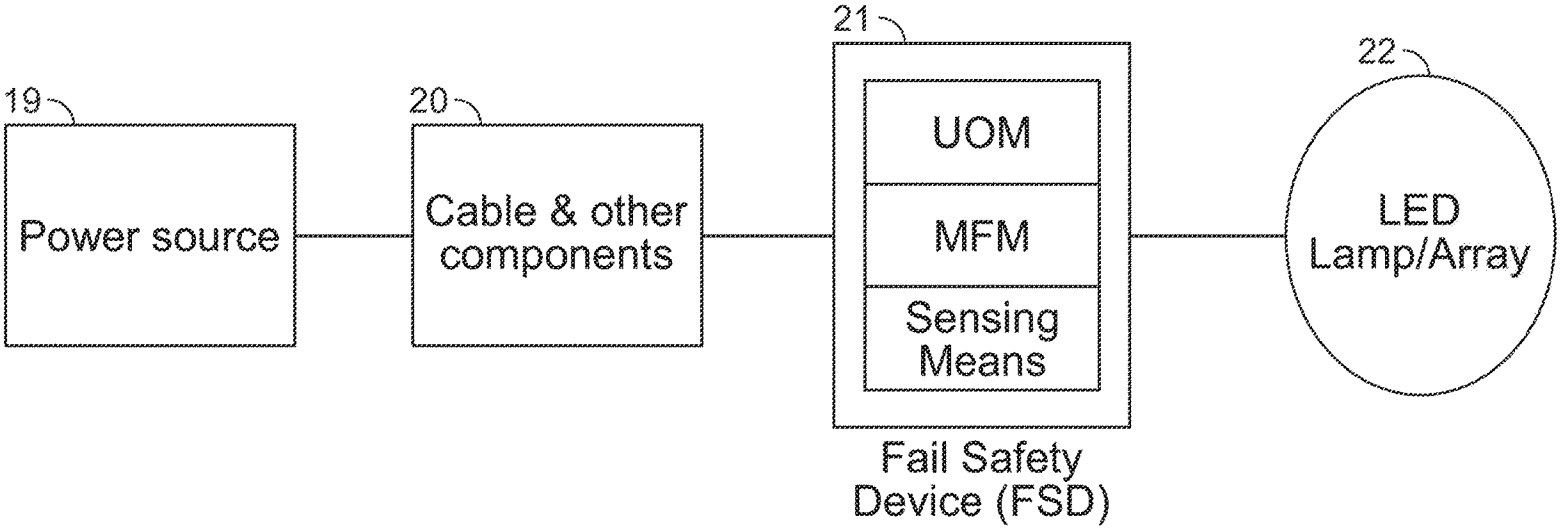

FIG. 2*a* shows an architecture of the existing LED signal lighting unit and LED lighting unit for street lighting. LED luminaire of any type use LED cluster for lighting as per the requirement. This figure shows the use of fail safety devices (21) between the power source (19) and LED cluster (22). One is on the station end for signal switching point for LED street light and alike. FIG. 2*a* shows fail safety devices (21, 21*a*) on both sides of the connecting medium, that is, the cable (20). At the railway signal part of the proving unit at power source side and other on the signal end LED cluster (part of the output unit) (FIGS. 3, 4 and 5), there is feedback communication wherein on either side the sub unit wherein validation of input and proving with respect to the feedback/communication for high integrity of functionality is done. In conventional method, non-interlocked either side validation, operation using the fail safety device is done where the fail safety means monitors the performance of the lamp at the lamp end and the power source at the power source end. In the present invention as illustrated for railway signal the LED lighting is first proven at the signal post (2) and then the feedback is sent on the cable (20), feeding the signal in a manner that is exclusive between the two fail safety devices (21, 21*a*). Then independent proving is done at the station (1) in the proving unit (24) to maintain the supply integrity.

The under and over control means (UOM/UOCM) is used to control the operation as per the control function or required parameter. For example, in LED lighting system it can be used for controlling power factor, total harmonic distortion (THD) or constant output with varying input and so on, whereas, in fail safety requirement it can be used for validating the monitored parameters like current, voltage etc. in their required ranges after it is received from the MFM (Multi feedback means) ORing and/or ANDing for the validation to cause the necessary proving.

The fail safety device (21, 21*a*) comprise an under and over control means (UOCM), various sensing means, and a multi-feed back means (MFM) operates on the feedback from said sensing means, the state of the under and over control means depending upon the input received from the said sensing means.

The sensing means is selected from a current sensing means, voltage sensing means, temperature sensing means, optical sensing means, any conventional or encoded/decoding means or any combinations thereof.

Figure 3A:
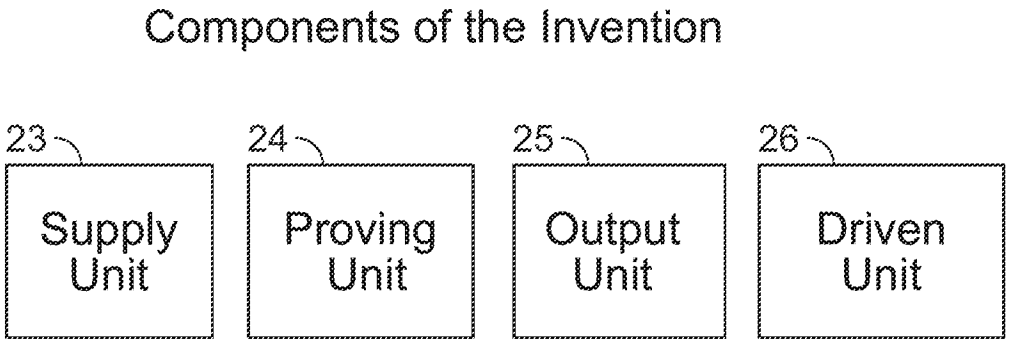
Figure 3B:
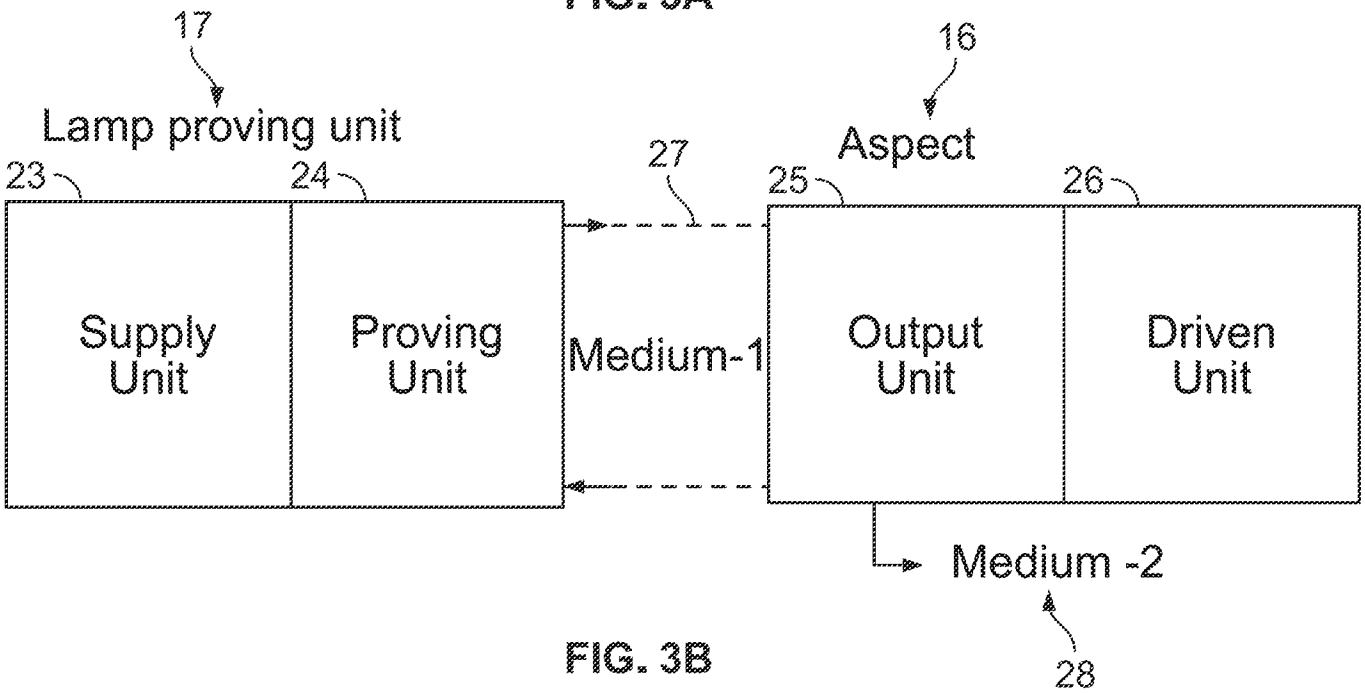
Figure 4:
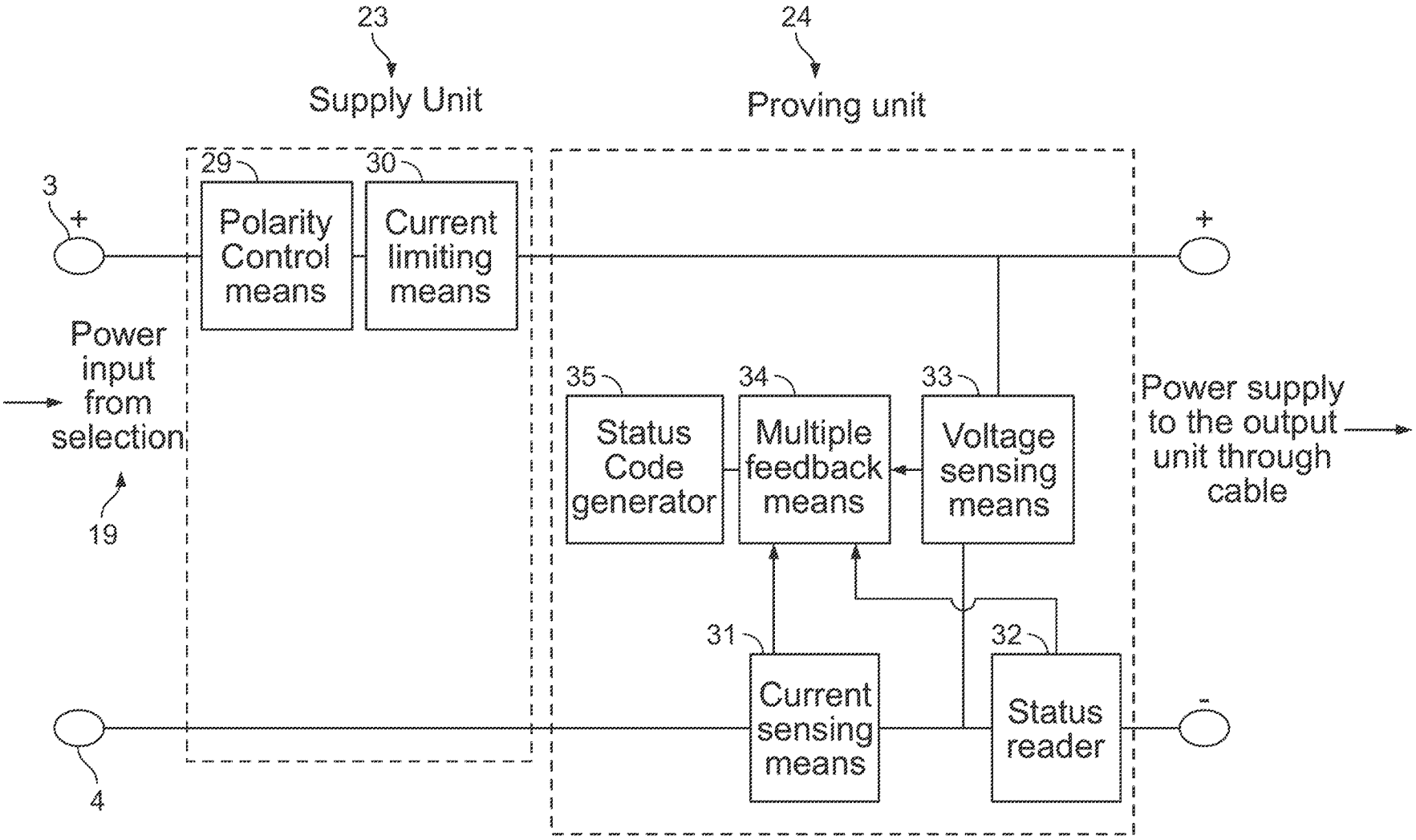
FIG. 4 shows Lamp proving unit with sub-component detail illustrating the present invention for a Railway Signal for a unit at the station
Figure 5:
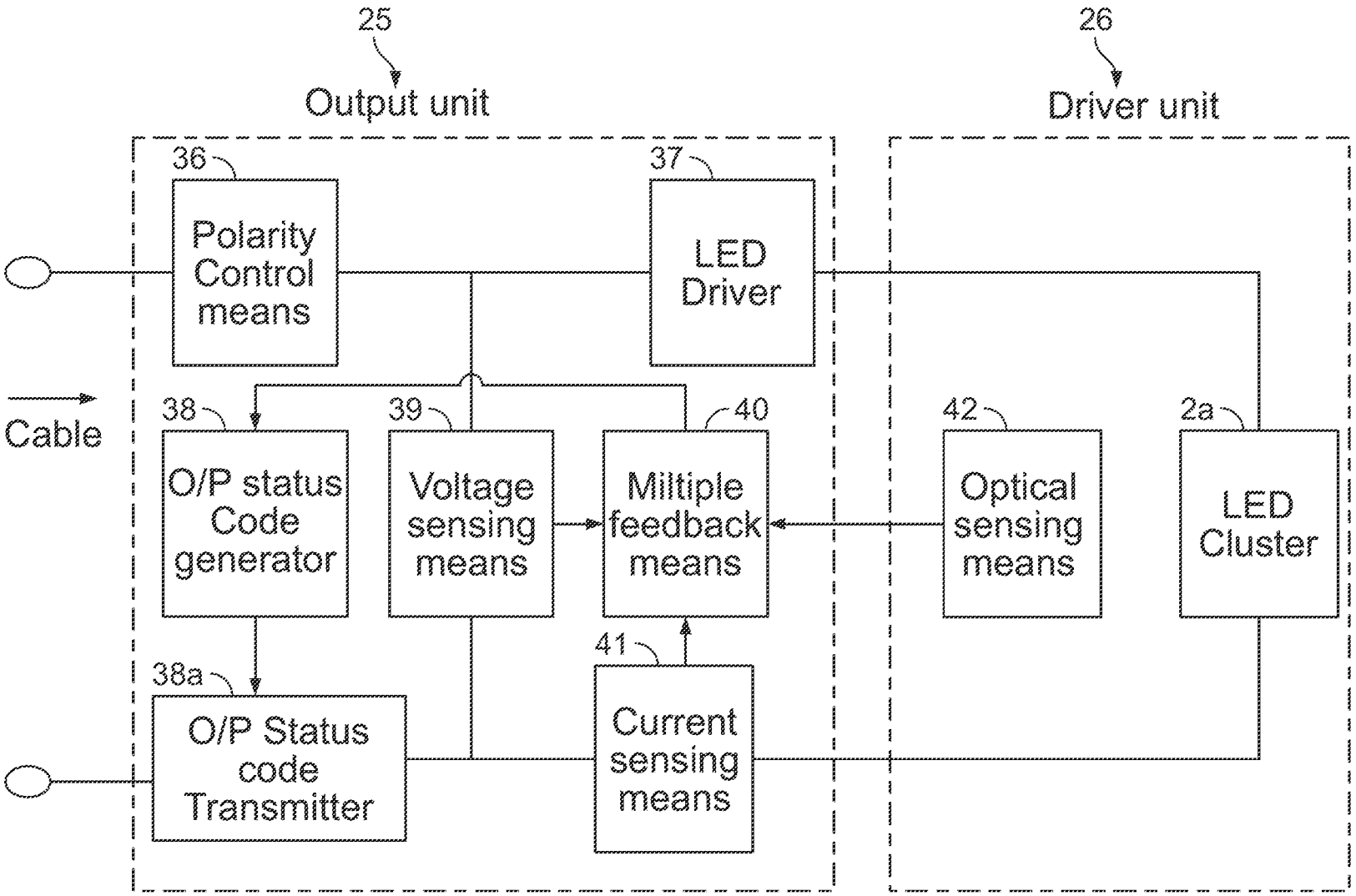
FIG. 5 shows output unit, driven unit, illustrating the present invention for a railway signal for a unit at the signal post.

FIG. 3(*a*) shows further the sub components of the invention and their connecting diagram. FIG. 3(*b*) gives more details of the unit at the station end and signal end, and FIG. 4 gives more details of the unit at the station end in illustrated example of the invention. FIG. 5 gives more details of the unit at the signal end in illustrated example of the invention where driven unit (26) includes the LED Cluster and optical sensing.

Each function is proven for its under or over performance in an interlocked manner. Thus, lamp proving takes place on the signal and feed back comprising the current, voltage and optical sensing is proven to be valid and is sent from the fail safety device (21) on the same cable (20) to the fail safety device (Lamp Proving unit) (21*a*) at the station end as a feedback signal in an independent domain on the cable (20), thus providing online information of the lamp status. The under or over control means (UOCM) is inherently fail safe.

The fail safety device (21*a*) of the proving unit (24) senses the feedback from the LED cluster/signal side (22) and along with the voltage and current sensing, with reference to the power source/selection output, in the multi-feedback means and under or over control means (UOCM) is again proven in fail-safe-manner at station side, and fail safe proving output is generated to drive the common relay for ECR (lamp checking relay) function.

AC Immunity

The sensing means for current and voltage are for DC and not AC. Thus, the presence of AC on the circuit does not affect the operation as it is not sensed. The components can withstand high voltages and their failure modes are fail safe. All components in the units are tested to qualify climatic tests as per the standards.

The lamp system is inherently fail safe online, as explained, above and with interlocking in lamp proving at signal and lamp proving with respect to selection at the station. Thus, the signal becomes immune to cable (medium 27) fault as well.

Working Principles and Details

Figure 2B:
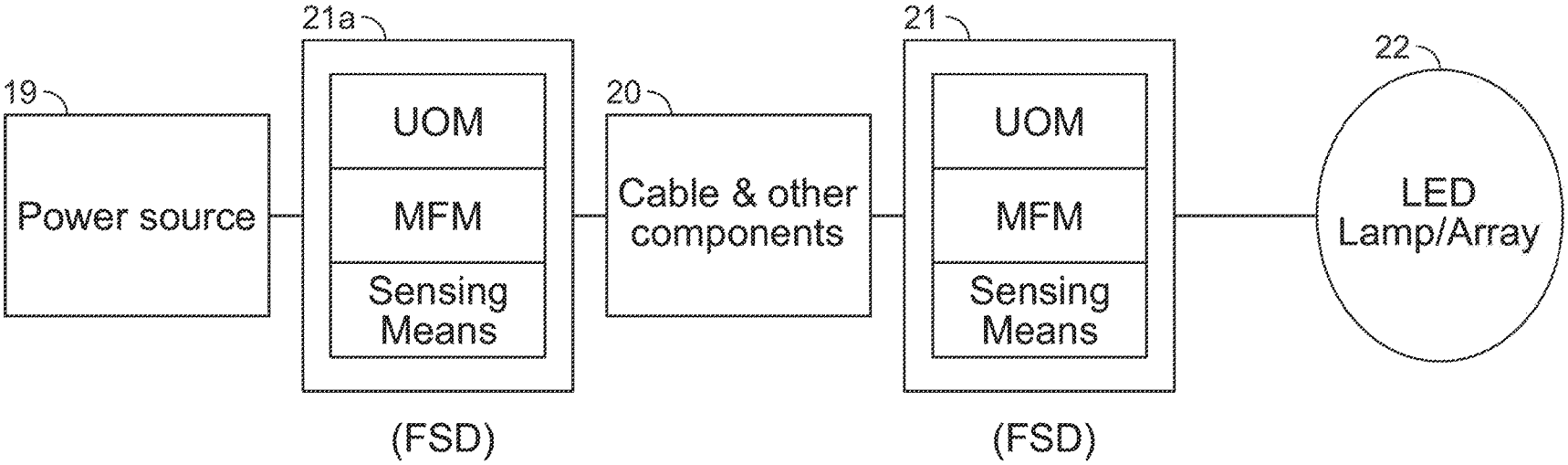

The LED signal cluster (22) is first validated on the signal post (2) with respect to its operation, and parameters with respect to selection supply from the station, to generate lamp status feedback sent over the medium in a separate domain to the station as in FIG. 2*b*, and the lamp status feedback received is validated again at the station (1), with the selection supply parameters ensuring supply integrity for generating the proving output in separate domain as in FIG. 2(*b*) to drive the common relay used for lamp status checking in fail safe manner with high level of integrity, requiring only the power consumption for efficient LED driving at the signal post and relay driving at station end, thereby also reducing the power consumption significantly with high level of safety and reliability, illustrating the invention as an example for railway signalling application.

The primary components of the product are the under over control means, multi-feedback means and various sensing means, keeping the monitored and/or control functions in separate domains to achieve high level of system integrity.

The method comprises of controlling the electrical system, by providing power supply from station (1) to an output unit (25) on the signal post (2) via a cable (20); and receiving power supply at the other end of the cable (20) on the signal post (2) and providing a valid output to the LED cluster (22), and generating and transmitting a validated output status code indicative of the output via the same cable (20); and receiving the transmitted output status code at the station (1) and generating a proving code based on the output status code thus received along with the power supply of the station and its voltage and current parameters sensed.

Lamp driving is DC which is not in the same domain of lamp immunity which is for AC (induced AC on cable in this case from the overhead 25 kV traction voltage).

Ensuring DC feed on the cable (20) only when fed from the selection from the station end results in DC feed to the aspect also acting as a selection code, which is validated by an inherently fail safe voltage sensing means across the line which only responds to DC. Thus, it becomes the selection reader cum line sensor. Cables have capacitive nature and such line capacitance leads to AC leakage induction, however, DC does not induce or leak due this feature of the cables.

Similarly, lamp status code (higher frequency carrier well within the cable bandwidth) and lamp driving (DC) are not in the same domain but are distinct from each other. Thus, lamp status code at signal is transported in fail-safe-manner to station precluding the possibility of WSF. In other words, if aspect is not lit ECR (Common relay for Lamp checking in this case) cannot be picked up/operated to indicate that lamp is lit. Further, ECR will pick up only when signal is selected and lit aspect status code is received. Inhibitors like latching, non-blanking, etc. are not required for fail-safe operation as in existing signals. The lamp self-restores after cable short, wherein correspondence of proving code and out status code are maintained in fail-safe-manner, further increasing safety & availability.

The lamp proving code is DC output, being generated with energy transformation (output for common relay/solid state interlocking (SSI) is not in same domain as selection code (DC from Selection), and status code from aspect, and inherently fail safe, the relay cannot be operated due to any failure or component shorting directly by the station DC supply or any external supply but only after validation and proving (ANDing in this case) using lamp status feedback (52), current fed from the station supply (51) due to signal selection and voltage output (56) from signal selection. AC noise filters (45, 53, 57, 60) and polarity control means (47, 59) keep the induced AC power dissipation to minimum and its affect on the sensing means, limiting means (46) to the minimum, thus also increasing the availability of the system by precluding the avoidable stress on components.

Sensing and proving in MFM and UOCM (50, 61, 66) are not disturbed which would in conventional system cause false operation. In the present system due to high functional integrity of the operation/proving this drawback of false operation is avoided while ensuring that the operation is as per control function by monitoring, proving, and validating to ensure high system level integrity with respect to the parameters or terms of reference.

Figure 6:
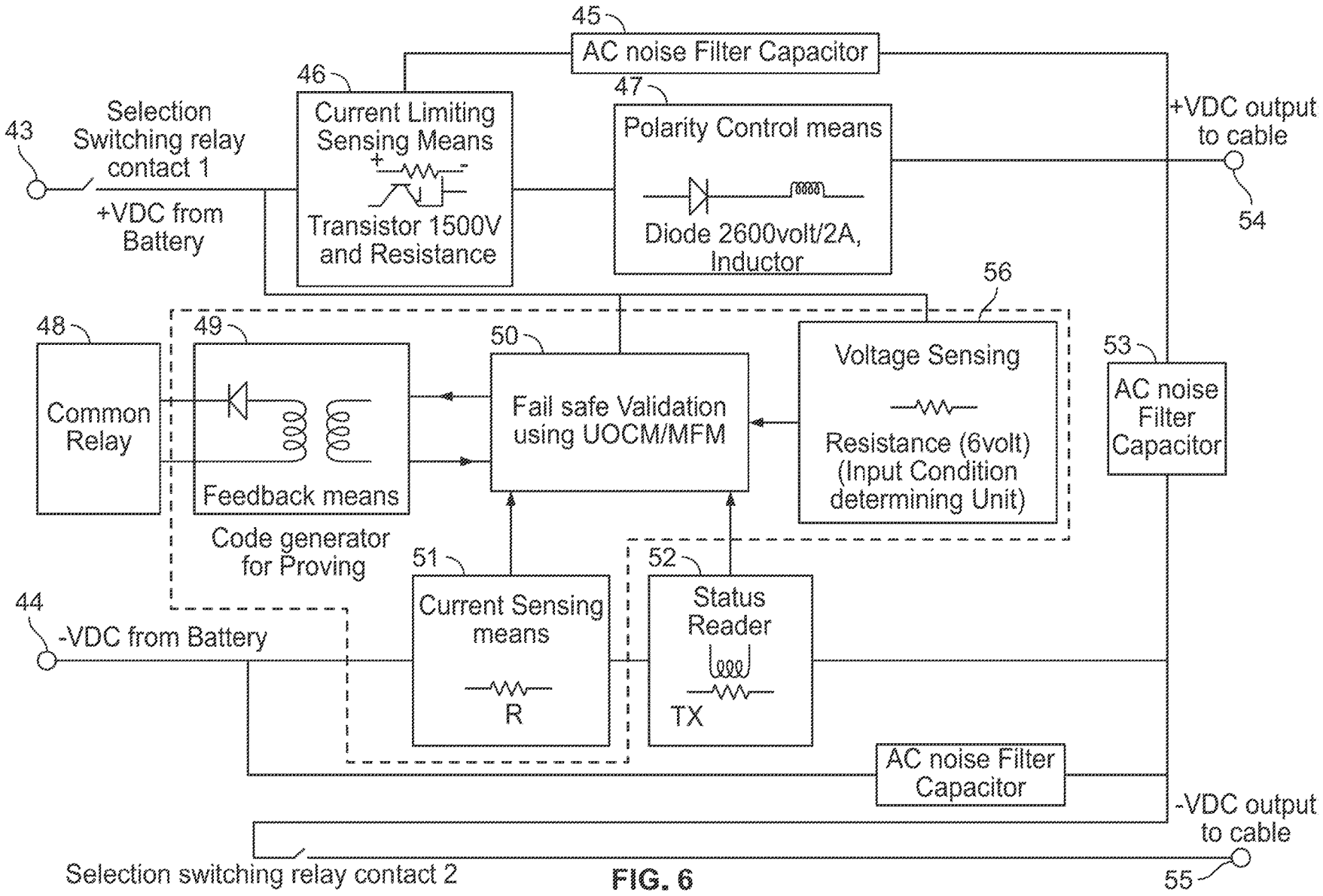
FIG. 6 shows block diagram of advanced 4 W LED DC Lit main signal (Lamp Proving Unit), illustrating the present invention for Railway Signal Unit at station.

Lamp Proving Unit at Station (LPU) FIG. 6

The current limiting means (1500V) (46) limits the flow of DC in one direction and polarity control means (comprises high voltage diodes in series/parallel combination for redundancy) (47) blocks the flow of AC in other direction and inductor (47) impedes the flow of AC in both directions). This ensures that the supply output is DC even under induced AC conditions. Thus, the DC output upon selection acts as a selection (supply) code, as well, which is due to a single LED cluster aspect configuration.

The current sensing means (51) reads only the current flowing out of the input from the selection supply to lamp proving unit (17), it senses DC current only. The inherently fail safe voltage sensing means (56) only senses the DC voltage at the input of the lamp proving unit (17). The aspect output status reader (52) with voltage sensing means (56) and current sensing means (51) are logically configured in the multi-feedback means and under over control means (50) which validates the lamp proving and checks all voltage and current to be within under over windows. The UOCM (50) is inherently fail safe. The AC noise filters (57) reduce the affect of AC in the MFM (50). The final inherently fail safe output of the UOCM (50) is transformed to magnetic energy and back to electrical energy giving fail safe proving output (code) DC, distinct in domain from the output status code and selection code (DC in this case).

Thus, while the lamp lighting circuit does not respond to the AC because the inherently fail safe voltage sensing means (56) are in the other domain, i.e. sensing response only to DC, so also the input source current sensing means (51), induced AC as high as 500 VAC over and above the 110 VDC supply, does not affect the normal working and lamp correspondence. Thus, the entire system is immune to the induced AC of 50 Hz and its harmonics.

Current limiting means (46) in this configuration in the lamp proving unit (17) does not activate in normal operation. However, in case of external interference it limits the current in one direction and blocks in the other, saving power dissipation as well as maintaining the DC selection supply selected through selection switching contacts. The power source (selection supply one conductor) is directly connected to input (8) of the lamp proving unit (17) and selection switched at output (18) of LPU to cause output to connect to the system cable at LPU output (4) for further connecting the negative output into the terminal rack in the relay room for further connection to cable conductor going to the signal post, whereas the LPU (17) output (3) carrying the positive output directly to the terminal rack for further connection to the second conductor of the cable going to the signal post. Thus, one output of the signal selection is switched at the input to LPU and other at the output. This sequencing of connections not only protects the unselected signal from undue stress of AC induced voltage but also prevents the dissipation of power which may be caused from the induced AC voltage when the LPU negative output (4) is connected.

Figure 7:
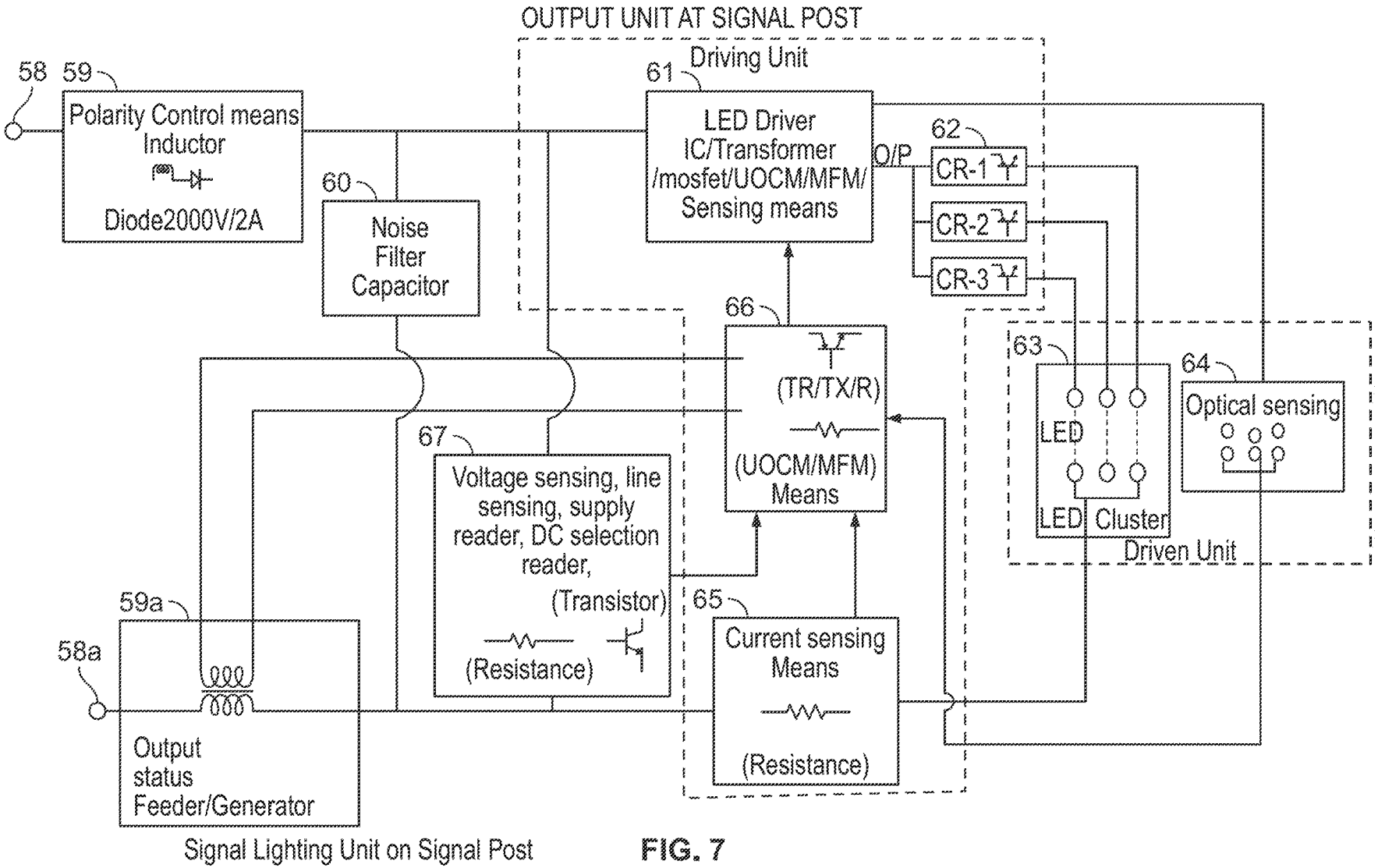
FIG. 7 shows advanced 4 W LED DC Lit signal lighting Unit, illustrating the present invention for Railway Signal Unit at signal post.

Signal Lighting Unit on Signal Post: FIG. 7

The output unit (25) for the signal post (2) is designed to respond to DC only and turns on only when DC voltage adequate to drive the LEDs is sensed. The voltage sensing means (67) does not sense AC and is inherently fail safe for this function. The status code of the lamp on signal post (2) is generated by the output unit (25) after the driven unit (26) is checked in inherently fail safe manner using under over control means (UOCM) and multiple feedback means (66), in functional priority sequence using optical sensing (64), voltage sensing (67) and current sensing means (65) wherein all functions are logically ANDed in a sequence. The status code is sent to the unit at the station (1) on the same cable (20), and is distinct from the supply code (being DC drive in this case) and former being independently generated higher frequency signal within the bandwidth of the cable (20).

Upon reading the feedback at the station (1) the proving unit (24) generates an output (proving code) to drive the common relay (62), this is distinct/independent from the supply code which is DC supply itself, in this case, and status code which is LED Lamp feedback.

Figure 8:
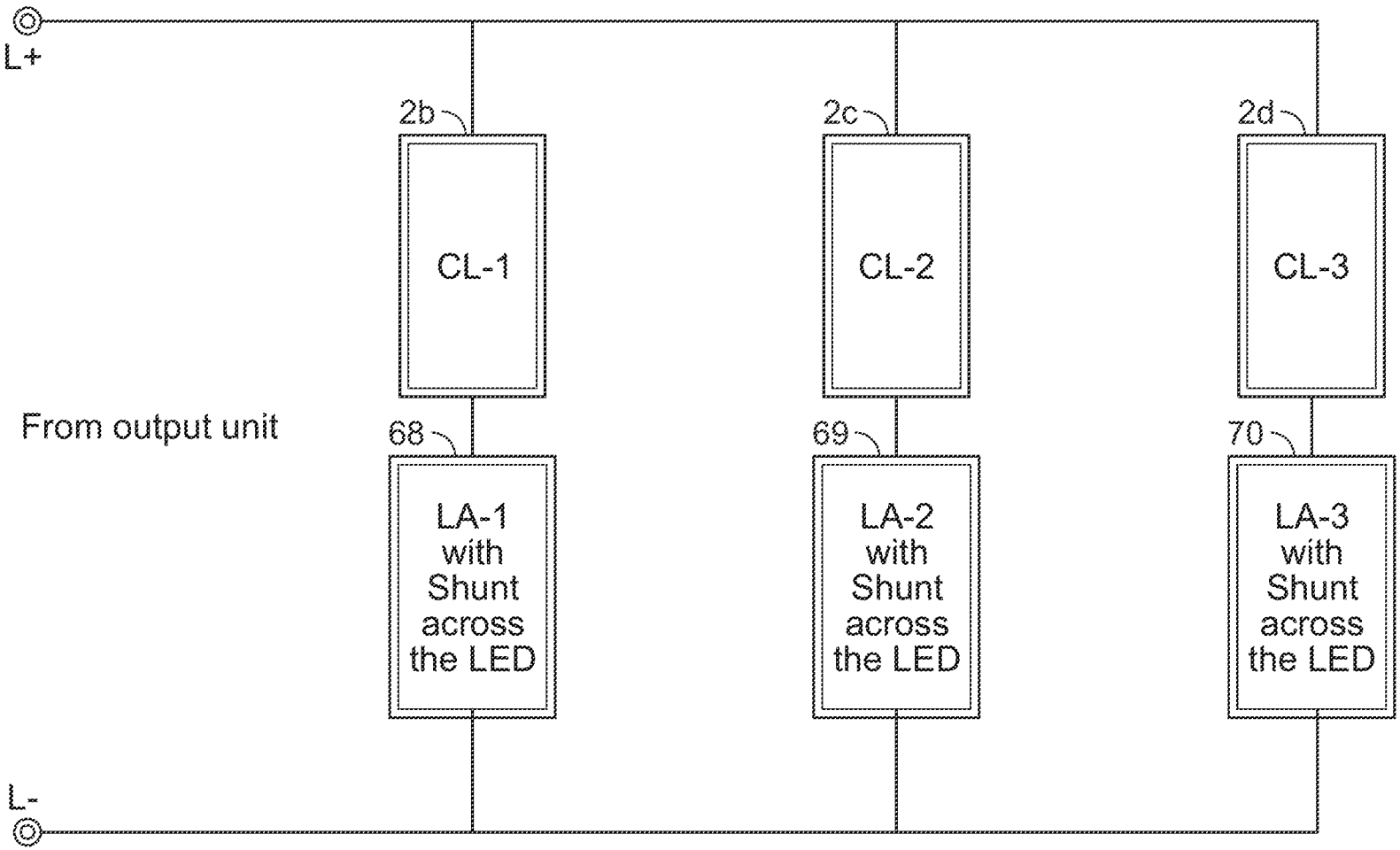
FIG. 8 shows driven unit LED Cluster with three LED Arrays & individual current limiting means

Driven Unit—LED Cluster: FIG. 8

The LED cluster comprises of three LED arrays (LA) (2, 26) each with independent current limiting (CL) means (2*b*, 2*c*, 2*d*). Thus, failure of one current limit circuit will not lead to affect on any other LED Array. Each LED has an independent shunt (68, 29, 70) so that in event of its open circuit failure, rest of the array remains lit.

Radio Ballise: Medium 2 shown in FIG. 3 is a modem comprising a Radio Ballise for cab signaling or advance station warning in FOG or similar application and is considered where required.

Solar Lighting is easily viable. In one option the outermost signal can be additional power using solar panel & battery so that in the event station supply fails, driver gets the warning of approaching signal. In another option all signals of a station can be powered by one solar power generation at the station with suitable battery bank.

Several embodiments of the present invention have been described. It should be apparent to those skilled in the art that various changes and modifications can be made without departing from the spirit and scope of the invention.

Figure 9:
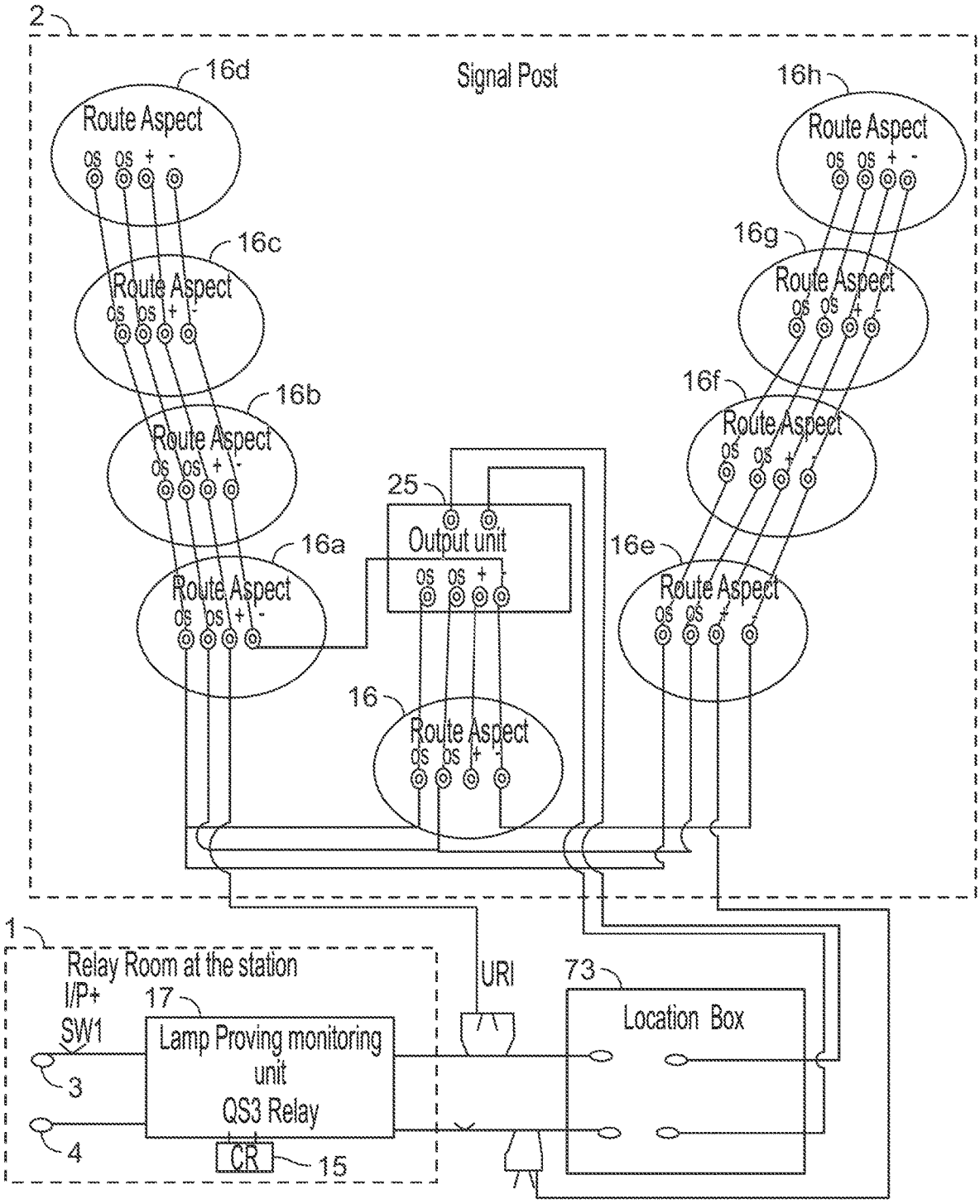
FIG. 9 shows multiple lamp system at Signal post, and output unit, illustrating the present invention for railway signalling application

Like FIGS. 7 and 8 for main signal, FIG. 9 illustrates railway signalling products according to this invention for reducing the power consumption by more than 65%, improving the reliability, safety of operation and increasing the availability. The unit at the signal post used for showing the route to which the forward movement of the train is marked to be seen by the oncoming train driver, by illuminating the left arm or the right arm or none for movement in the existing direction. Unit at the signal post consists of output unit and various LED (Route) aspects as driven units. The pilot lamp is selected both for right as well as left route indication. The balance four lamps either for right or left route are selected as per the indication need. The unit at the station is required to do lamp proving of the aspects lit at the signal post far way whether the correct lamps as selected at station are lit properly as per requirement or not. The medium interconnecting the two units is existing electrical cable with its conductors going directly and/or through the location box in the field along the track side. The existing medium interconnecting the sub units is also adapted as it is, and the benefits are achieved. Though not shown, it is possible to use another medium at the station directly from lamp proving unit or through datalogger to communicate to another location or another medium from the signal post to transmit the status of the of the signal lighting to another location, the said such location may be another station or a locomotive.

The wiring diagram of the sub units [Driven Units—Route Aspect, Output Unit] illustrating addition of optical sensing of individual aspects by paralleling the outputs & separately addition of current sensing of individual aspects by having common return for DC(−) connection & Separate Parallel paths for DC(+) connection for either Route [Four aspects] as per selection is shown.

For the lamp proving at the station Lamp proving unit at station is connected through the signalling cable to the unit at the signal post through the interconnections at the location box as per need.

Figure 10:
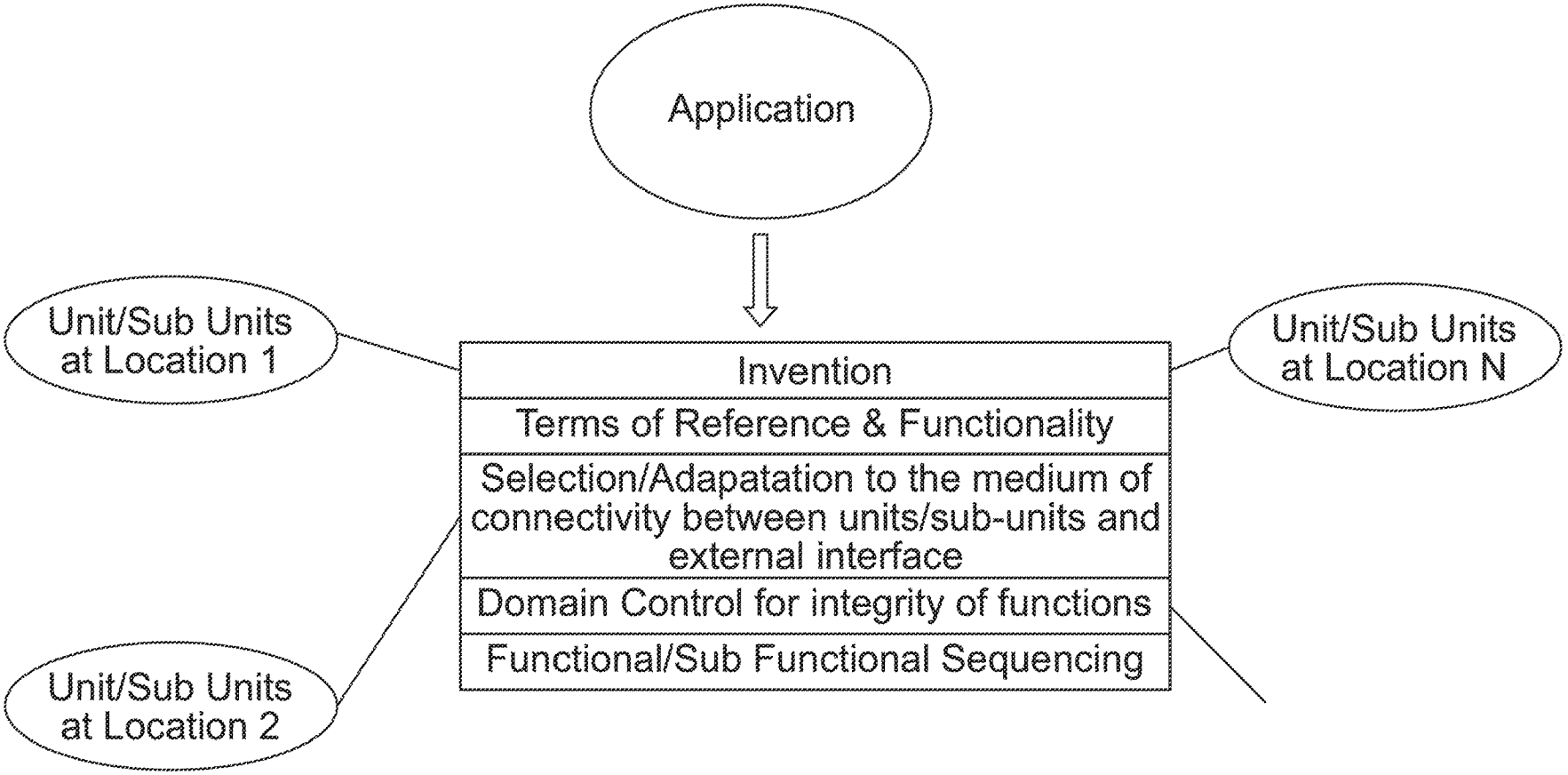
FIG. 10 shows the brief flow chart of the invention

FIG. 10 describes briefly how the invention operates on a defined application, end use. First, the need of using the invention for the application is there or not is identified. After it is ascertained that the application is only or best workable with the invention then, the application is further scrutinised and the terms-of-reference, functionality (Control & monitoring functions) are identified and their interrelationships and integrity requirements for safe, efficient & reliable operation worked out as per the invention.

The available mediums or the flexibility of using the other mediums is checked out and the connectivity between Units/Sub Units, external interface are worked out for the required energy sources and mediums as well as the mediums which are definable as per the invention, either way domain for integrity of the functions, internal functioning and inter unit functioning not affecting the user environment/need are worked out in conjunction or separately with functional/sub-functional sequencing to improve the working with respect to safety, reliability & efficiency levels.

The inter unit/subunit at a location and/or inter location networking allows the benefits of the invention for improving safety, integrity levels of operation, efficiency, reliability & availability.

One of the main embodiment of the present invention relates to A control system for us in applications requiring high level of functional integrity at one or more location wherein:

- at least one unit (16, 17, 2,73,74,75) at the location is connected through one or more connecting medium (20, 27, 28) and
- at least one power source (11) is connected to the unit at the location
- the said at least one unit comprising sub units (23, 24, 25, 26) in any combination, the said system requiring at least one monitoring and control function with one or more term of reference,
- wherein, the said at least one control function is in a different domain from at least the one monitoring function and/or another control function, and one or any unit/subunit (1, 2, 23, 24, 25, 26) of the system,
- and at least one sub unit (23, 24, 25, 26) in the unit (1, 2) is provided with a dedicated fail safety device (21, 21*a*).

Yet another embodiment of the present invention provides a system, wherein the subunits (23, 24, 25, 26) comprises of one or more in any combination, supply unit, proving unit, output unit and driven unit, at a location comprising of sub-components 29, 30, 32, 35, 38, 38*a*, 45, 46, 47, 49, 52, 59*a*, 61, fail safety device (21,21*a*), sensing means (31, 33), 39,41,42,51,56,64, 65,67 any conventional means.

Still another embodiment of the present invention provides a system, wherein the fail safety device comprises of Multiple feedback means (MFM), Under Over Control Means (UOM/UOCM), and any sensing means.

Still yet another embodiment of the present invention provides a system, wherein the control function comprises of activity to perform in accordance with the application for the end use with or without the conditionality of terms of reference.

Yet still another embodiment of the present invention provides a system, wherein the monitored function comprises of sensing feed back communication between the units, sub units, intra-sub units at the location and/or between the locations to perform the control functions.

Still another embodiment of the present invention provides a system, wherein in the said sensing means the outputs are combined such as optical sensing (42) and/or current sensing (41) are added by paralleling the outputs of different units/sub units at a location.

Yet still another embodiment of the present invention provides a system, wherein the sensing means may be selected from voltage sensing means AC-DC, AC or DC, current sensing means AC-DC or AC or DC, optical sensing means, thermal sensing means, magnetic sensing means or any type of conventional sensing means.

Another embodiment of the present invention provides a system, wherein the domain distinction between the control and monitored function is caused by transformation of energy form, re-transformation to the same energy form with isolation, encoding in the same energy form, polarising, limiting, changing levels, different energy forms, and alike, such that, the functional integrity, confidence level is achieved, on the same or different connecting mediums intra or inter location.

Still another embodiment of the present invention provides a system, wherein the supply unit (23), also comprises either alone or in combination the current limiting means (30, 46) and polarity control means (29).

Yet another embodiment of the present invention provides a system, wherein the proving unit (24) also comprises either alone or in combination, status or proving code generator (35), Multiple Feedback means (34), Under Over Control Means (33), any sensing means, status reader (32) and noise filter (45) for forwarding combined sensing and proving of monitored functions, outputs, inputs at supply and/or output unit.

Still another embodiment of the present invention provides a system, wherein the output unit (25) also comprises either alone or in combination sensing means, output status feeder/generator (59*a*), noise filter (60), multiple feedback means (40), under over control means output liming means (2*b*, 2*c*, 2*d*, 62) at least one power regulator (61) and optionally polarity control means (59).

Yet still another embodiment of the present invention provides a system, wherein said sensing means is preferably optical sensing (42, 64) and said optical sensing is formed by a plurality of tubes provided with photo-sensing device and a cup placed in series or parallel combination, the photo-sensing device used is an LDR, and/or phototransistor, and/or photodiode.

Still another embodiment of the present invention provides a system, wherein said feedback means (49, 61, 37) comprises a transformer to generate the DC signal power for the output, wherein the said feedback means comprises (52, 59*a*) comprises a transformer to feed, read AC signal power.

Another embodiment of the present invention provides a system, wherein the driving and/or proving of the driven unit/subunits is not in the domain of driven unit/subunit immunity.

Still another embodiment of the present invention provides a system, wherein the driven unit(s) (26) are kept in separate domain to provide immunity to false operation and is operated or controlled by the control system to achieve the application.

Yet still another embodiment of the present invention provides a system, wherein the power source (19) consists of a battery unit and optionally solar panel based battery unit at any location.

Still another embodiment of the present invention provides a system, wherein the output unit (25) and/or the proving units (24) are capable of transmitting telemetric and/or wireless signals to a remote location, and handshake any control and/or monitoring information of any unit and/or driven load in the system.

Yet still another embodiment of the present invention provides a system, wherein the telemetric signals are communicated to a remote location through a data logger and cable and/or wireless system (20, 27, 28).

Still another embodiment of the present invention provides a system, wherein all units of the system are connected through one or more than one mediums and will be interlocked with online handshake inherently validating the output of various sensing means for the high confidence level output with respect to the terms of reference, operation Yet another embodiment of the present invention provides a system, wherein the units, and the sub units within the units (1, 2, 23, 24, 25, 26) and sub components within the sub units are interconnected in functional priority sequence to logically preclude preferably the undesirable performance or failure, both in terms of systematic and/or functional failure of the unit/subunit (1, 2, 23, 24, 25, 26).

Still yet another embodiment of the present invention provides a system, wherein the sequencing of functions/sub functions is achieved by control of timing, physical connection, operating voltage/current/any form of input level/quantum control.

Another embodiment of the present invention provides a system, wherein the intra sub-units, sub components are any type of sensing means, coupling means, generating means, status reading means, status generating means, energy filter means, multiple feedback means, under over control means, audio and/or visual, alarm or any other conventional means or any combinations thereof.

Yet still another embodiment of the present invention provides a system, wherein confidence of high level is proven for a key function to translate the same level of confidence to other functions proven based on the said key function, at the same or another location.

Still another embodiment of the present invention provides a system, wherein the power source (19) that provides the power supply which is either AC supply or DC supply that is to be used to energise the driven unit is superimposed with a code to change its domain from any other supply that may get applied to the driven unit (26), or another driven unit running on the same supply.

Yet still another embodiment of the present invention provides a system, wherein the system can be used in signalling system for railways, medical industry and such other areas to meet the safety & integrity requirements.

Further embodiment of the present invention provides a control system for providing reliable LED based signalling lamps based on optical feedback the said system comprising a supply unit (23), proving unit (24), output unit (25), and driven unit-LED cluster (26), wherein:

- at least one power source (19) is connected to one or more supply unit (23), optionally, with one or more proving unit (24) on one side of one or more connecting medium (20) and
- one or more output unit (25) along with one or more driven unit (26) connected to the other side of the said one or more connecting medium (20);
- said system requiring at least one monitoring and control function with one or more term of reference, and
- the said control function being in different domain from at least the one monitoring function, and one or any unit of the system,
- said LED being provided with a dedicated fail safety device (21) connected between said LED (2, 22) and the power source (19), and said plurality of LED cluster lamps (2) also being provided with an independent second fail safety device (21*a*) downline towards the power source (19), said independent second at least one fail safety device (21*a*) monitoring the status of at least one LED Cluster/lamp, the said optical feedback travelling on the signalling cable (20) feeding power supply to the output unit (25) being sensed at the station (1) in the proving unit (24) together with the selection supply voltage at the supply unit (23) and current flowing out of the selection supply at the station (1) and generating a proving code to provide fail safe output to drive a common Relay (15, 48) as ECR wherein this output voltage constitutes a fail Safe output and can be used to interface with solid state interlocking (SSI).

Yet still another embodiment of the present invention provides a system, wherein the driven unit (26) comprises LED cluster lamps with or without optical sensing means and either alone or in combination control means, current limiting, current sensing means or any conventional means.

Still another embodiment of the present invention provides a system, wherein the said LED cluster (2, 26) is provided with active shunts (68, 69, 70) across each LED in the series arrays or part series array or complete LED array, so that upon an LED Failure there no complete failure Still another embodiment of the present invention provides a system, wherein the said LED cluster (2, 26) is provided with passive shunts (68, 69, 70) across each group/LED of LEDs in the series arrays, so that upon an LED Failure there no complete failure.

Still another embodiment of the present invention provides a system, wherein the supply unit (23) comprises either alone or in combination the current limiting means (30) and polarity control means (29) wherein the current limiting means (30) limits the flow of DC in one direction & polarity control means (29, 47) blocks the flow of AC in other direction and an inductor (47) impedes the flow of AC in both directions to ensure that the supply output (54) is DC even under induced AC conditions and thus the DC Output (54, 55) upon selection (18,6) acts as a selection (supply) code as well for a single LED cluster/Output unit driving the driven unit (26).

Yet still another embodiment of the present invention provides a system, wherein said LED cluster (2, 26) is formed by monoconic or biconic or smd LEDs, with or without additional optics/optical control.

Still another embodiment of the present invention provides a system, wherein the driven unit (26) comprises of redundancy and reliability, at least two LED Arrays each with independent current limiting means (2*b*, 2*c*, 2*d*, 62) so that failure of one current limit circuit will not affect other LED array.

Still another embodiment of the present invention provides a system, wherein the optical feedback/feedback is generated after individually validating the parameters of voltage, current, optical, and such other factors for correctness as per the defined requirements at the location/unit, logically generating the combined correctness in fail safe manner as the feedback signal of high integrity.

Further yet another embodiment of the present invention provides a method for providing reliable LED based signalling lamps based on optical feedback the said method comprising of controlling the system, by providing power source (19) for power supply from location to an output unit (25) on the signal post via a cable (20); and receiving power supply at the other end of the cable (20) on the signal post (2, 25) and providing a valid output to the LED cluster, and generating and transmitting a validated output status code indicative of the output via the same cable (20); and receiving the transmitted output status code at the location (1) and generating a proving code based on the output status code thus received along with the power supply of the station (1) and its voltage and current parameters sensed, wherein:

at least one power source (19) is connected to one or more supply unit (23), optionally, with one or more proving unit (24) on one side of one or more connecting medium (20) and one or more output unit (25) along with one or more driven unit (26) connected to the other side of the said one or more connecting medium (20);

said system requiring at least one monitoring and control function with one or more term of reference, and the said control function being in different domain from at least the one monitoring function, and one or any unit of the system, said LED being provided with a dedicated fail safety device (21) connected between said LED (22) and the power source (19), and said plurality of LED cluster lamps also being provided with an independent second fail safety device (21*a*) downline towards the power source (19), said independent second fail safety device (21*a*) monitoring the status of one or more of lamps (2, 26, 16,16*a*, 16*b*, 16*c*, 16*d*, 16*e*, 16*f*, 16*g*, 16*h*), the said optical feedback travelling on the same signalling cable (20) feeding power supply to the output unit (25), being sensed at the location (1) in the proving unit together with the selection supply voltage, at the supply unit (23) and current flowing out of the selection supply at the station (1) and generating a proving code to provide fail safe output to drive a common relay (48,15) as ECR wherein this output voltage constitutes a Fail Safe Output and can be used to interface with Solid State Interlocking (SSI).

Still another embodiment of the present invention provides a method, wherein said location (1) is a station or a relay room and/or a locomotive connected through another medium.

Yet another embodiment of the present invention provides a method, wherein at least one more proving is generated for the same output status code (59) and/or at least one more output status code is generated from the same proving code using the same medium or another medium at the same or another location.

Still another embodiment of the present invention provides a method, wherein the status code of the lamp on signal post (2) is generated by the output unit (25) after it is checked in inherently fail safe manner using under over control means and multiple feedback means (66) in functional priority sequence using optical sensing (64), voltage sensing (67) and current sensing means (65) wherein all functions are ANDed.

Yet another embodiment of the present invention pro vides a method, wherein, status code is the LED Lamp feedback (59*a*) and proving code is the output generated by the proving unit (24).

Still yet another embodiment of the present invention provides a method, wherein, the monitoring function inter unit/subunit and/or intra unit/sub unit is in a separate domain from the one or any other monitoring function.

ADVANTAGES OF THE INVENTION

The advantages of the present invention is reduction in energy consumption, capital costs, maintenance costs, improving safety & operation integrity, in various systems operating and monitoring various applications and driven units, sub unit for example such as LED based lighting systems, logically integrating remote units, etc., by additionally implementing the underlying concepts of the present invention which are:

- driven unit driving is not in the domain of Driven Unit Immunity with respect to the terms of reference;
- a monitored function/s in the electrical system & Driving of the driven unit are kept in separate domain to achieve high level of system operation integrity;
- all components of the system connected through one or more than one medium/s will be interlocked with online handshake inherently validating the output of various sensing means for the high confidence level output with respect to the terms of reference;
- the interconnectivity of the components & the sub components within the components is done in functional priority sequence to logically preclude the wrong side failure both in terms of Systematic failure & component failures;
- inherently fail safe methodology is adopted to prove the key function, thereby facilitating the other functions to be determined through logical means with high degree of confidence level.
- there shall never be any possibility of change in colour of signal light unit with variation in temperature, current, voltage and ageing to unsafe side i.e. in any usual/unusual circumstances.

Variations and modifications are possible based on the above disclosure without departing from the spirit and scope of the invention. While specific language has been used to describe the disclosure, any limitations arising on account of the same are not intended. As would be apparent to a person in the art, various working modifications may be made to the method in order to implement the inventive concept as taught herein.

We claim:

1. A control system for use in applications requiring high level of functional integrity at one or more locations wherein:

- at least one functional device comprising at least one input and at least one function to perform at least one output (16, 17, 2, 73, 74, 75) at the location connected through one or more connecting medium (20, 27, 28) and
- at least one power source (11) is connected to the functional device at the location,
- the at least one functional device comprising sub units (23, 24, 25, 26) in any combination,
- the system requiring at least one monitoring function and at least one control function with one or more terms of reference,
- wherein, the at least one control function is in a different domain from the at least the one monitoring function, another control function, or a combination thereof and one or any unit/subunit (1, 2, 23, 24, 25, 26) of the system,
- and at least one sub unit (23, 24, 25, 26) in the unit (1, 2) is provided with a dedicated fail safety device (21, 21*a*).

2. The control system as claimed in claim 1, wherein the subunits (23, 24, 25, 26) comprises one or more in any combination, a supply unit, proving unit, output unit and driven unit, at a location comprising sub-components (29, 30, 32, 35, 38, 38*a*, 45, 46, 47, 49, 52, 59*a*, 61), fail safety device (21, 21*a*), sensing means (31, 33, 39, 41, 42, 51, 56, 64, 65, 67) or a combination thereof.

3. The control system as claimed in claim 1, wherein the fail safety device comprises Multiple feedback means (MFM), Under Over Control Means (UOM/UOCM), or a sensing means.

4. The control system as claimed in claim 1, wherein the control function comprises activity to perform in accordance with the application for the end use with or without the conditionality of terms of reference.

5. The control system as claimed in claim 1, wherein the monitoring function comprises sensing feed back communication between the units, sub units, intra-sub units at the location, between the locations or a combination thereof to perform the control functions.

6. The control system as claimed in claim 1 further comprising sensing means, wherein in the sensing means outputs are combined with optical sensing (42), current sensing (41) or a combination thereof are added by paralleling outputs of different units/sub units at a location.

7. The control system as claimed in claim 3, wherein the sensing means is selected from voltage sensing means AC-DC, AC or DC; current sensing means AC-DC, AC, DC; optical sensing means, thermal sensing means, and magnetic sensing means or a combination thereof.

8. The control system as claimed in claim 1, wherein the domain distinction between the control function and monitored function is caused by transformation of energy form, re-transformation to the same energy form with isolation, encoding in the same energy form, polarising, limiting, changing levels, or different energy forms, or a combination thereof such that the functional integrity, confidence level is achieved, on the same or different connecting mediums intra or inter location.

9. The control system as claimed in claim 2, wherein the supply unit (23), further comprises either alone or in combination the current limiting means (30, 46) and polarity control means (29).

10. The control system as claimed in claim 2, wherein the proving unit (24) further comprises either alone or in combination, status or proving code generator (35), Multiple Feedback means (34), Under Over Control Means (33), any sensing means, status reader (32) and noise filter (45) for forwarding combined sensing and proving of monitored functions, outputs, inputs at supply, or output unit or a combination thereof.

11. The control system as claimed in claim 2, wherein the output unit (25) further comprises either alone or in combination sensing means, output status feeder/generator (59*a*), Noise filter (60), Multiple Feedback means (40), Under Over Control Means output liming means (2*b*, 2*c*, 2*d*, 62) at least one power regulator (61) and optionally polarity control means (59).

12. The control system as claimed in claim 7, wherein the sensing means is optical sensing (42, 64) and the optical sensing is formed by a plurality of tubes provided with photo-sensing device and a cup placed in series or parallel combination, the photosensing device used is light dependent resistance (LDR), phototransistor, or photodiode or a combination thereof.

13. The control system as claimed in claim 3, wherein said feedback means (49, 61, 37) comprises a transformer to generate a DC signal power for output, wherein feedback means comprises (52, 59*a*) comprising a transformer to feed, read AC signal power.

14. The control system as claimed in claim 2, wherein the driving, proving unit or a combination thereof of the driven unit/subunits is not in the domain of driven unit/subunit immunity.

15. The control system as claimed in claim 2, wherein the driven unit(s) (26) are kept in separate domain to provide immunity to false operation and is operated or controlled by the control system to achieve the application.

16. The control system as claimed in claim 1, wherein the power source (19) consists of a battery unit and optionally solar panel based battery unit at any location.

17. The control system as claimed in claim 2, wherein the output unit (25), the proving units (24) or a combination thereof are capable of transmitting telemetric, or wireless signals to a remote location, and handshake any control, or monitoring or a combination thereof information of any unit, driven load or a combination thereof in the system.

18. The control system as claimed in claim 17, wherein the telemetric signals are communicated to a remote location through a data logger and cable, wireless system (20, 27, 28) or a combination thereof.

19. The control system as claimed in claim 1, wherein all units of the system are connected through one or more than one mediums and will be interlocked with online handshake inherently validating the output of various sensing means for the high confidence level output with respect to the terms of reference, operation.

20. The control system as claimed in claim 1, wherein the units, and the sub units within the units (1, 2, 23, 24, 25, 26) and sub components within the sub units are interconnected in functional priority sequence to logically preclude preferably the undesirable performance or failure, both in terms of systematic failure, functional failure or a combination thereof of the unit/subunit (1, 2, 23, 24, 25, 26).

21. The control system as claimed in claim 20, wherein the sequencing of functions/sub functions is achieved by control of timing, physical connection, operating voltage/current/ any form of input level/quantum control.

22. The control system as claimed in claim 1, wherein the intra sub-units, sub components are any type of sensing means, coupling means, generating means, status reading means, status generating means, energy filter means, multiple feedback means, under over control means, audio, visual, alarm or any combinations thereof.

23. The control system as claimed in claim 8, wherein a confidence of high level is proven for a key function to translate the same level of confidence to other functions proven based on the key function, at the same or another location.

24. The control system as claimed in claim 1, wherein the power source (19) that provides the power supply which is either AC supply or DC supply that is to be used to energise the driven unit is superimposed with a code to change its domain from any other supply that may get applied to the driven unit (26), or another driven unit running on the same supply.

25. The control system as claimed in claim 1, wherein the system can be used in signalling system for railways, medical industry and other areas to meet safety and integrity requirements.

26. A control system for providing reliable LED based signalling lamps based on optical feedback the system comprising a supply unit (23), proving unit (24), output unit (25), and driven unit-LED cluster (26), wherein:

at least one power source (19) is connected to one or more supply unit(s) (23), optionally, with one or more proving unit (24) on one side of one or more connecting medium (20) and one or more output unit (25) along with one or more driven unit (26) connected to the other side of the one or more connecting medium (20);

said system requiring at least one monitoring and control function with one or more term of reference, and the control function being in a different domain from at least the one monitoring function, and one or any unit of the system, said LED being provided with a dedicated fail safety device (21) connected between said LED (2, 22) and the power source (19), and said plurality of LED cluster lamps (2) being provided with an independent second fail safety device (21*a*) downline towards the power source(19), said independent second at least one fail safety device (21*a*) monitoring the status of at least one LED Cluster/lamp, the optical feedback travelling on a signalling cable (20) feeding power supply to the output unit (25) being sensed at the a station (1) in the proving unit (24) together with selection supply voltage at the supply unit (23) and current flowing out of the selection supply at the station (1) and generating a proving code to provide fail safe output to drive a common Relay (15, 48) as ECR wherein this output voltage constitutes a fail Safe output and can be used to interface with solid state interlocking (SSI).

27. The control system as claimed in claim 26, wherein the driven unit (26) comprises LED cluster lamps with or without optical sensing means and either alone or in combination control means, current limiting, current sensing means or any conventional means.

28. The control system as claimed in claim 26, wherein the LED cluster (2, 26) is provided with active shunts (68, 69, 70) across each LED in the series arrays, part series array or complete LED array, or a combination thereof so that upon an LED failure there no complete failure.

29. The control system as claimed in claim 26, wherein the LED cluster (2, 26) is provided with passive shunts (68, 69, 70) across each group/LED of LEDs in the series arrays, so that upon an LED Failure there no complete failure.

30. The control system as claimed in claim 26, wherein the supply unit (23) comprises either alone or in combination current limiting means (30) and polarity control means (29) wherein the current limiting means (30) limits the flow of DC in one direction and polarity control means (29, 47) blocks the flow of AC in the other direction and an inductor (47) impedes the flow of AC in both directions to ensure that the supply output (54) is DC even under induced AC conditions and thus the DC Output (54, 55) upon selection (18, 6) acts as a selection (supply) code as well as for a single LED cluster/Output unit driving the driven unit (26).

31. The control system as claimed in claim 26, wherein said LED cluster (2, 26) is formed by monoconic or biconic or surface mounted device (smd) LEDs, with or without additional optics/optical control.

32. The control system as claimed in claim 26, wherein the driven unit (26) comprises for redundancy and reliability, at least two LED Arrays each with independent current limiting means (2*b*, 2*c*, 2*d*, 62) so that failure of one current limit circuit will not affect other LED array.

33. The control system as claimed in claim 26 wherein the optical feedback/feedback is generated after individually validating parameters of voltage, current, optical, and such other factors for correctness as per defined requirements at the location/unit, logically generating the combined correctness in fail safe manner as the feedback signal of high integrity.

34. A method for providing reliable LED based signalling lamps based on optical feedback the method comprising controlling a system, by providing power source (19) for power supply from location to an output unit (25) on a signal post via a cable (20); and receiving power supply at the other end of the cable (20) on the signal post (2, 25) and providing a valid output to a LED cluster, and generating and transmitting a validated output status code indicative of the output via the cable (20); and receiving the transmitted output status code at the location (1) and generating a proving code based on the output status code received along with the power supply of a station (1) and its voltage and current parameters sensed, wherein:

at least one power source (19) is connected to one or more supply unit (23), optionally, with one or more proving unit (24) on one side of one or more connecting medium (20) and one or more output unit (25) along with one or more driven unit (26) connected to the other side of the one or more connecting medium (20);

said system requiring at least one monitoring and control function with one or more term of reference, and the control function being in a different domain from at least one monitoring function, and one or any unit of the system, said LED being provided with a dedicated fail safety device (21) connected between said LED (22) and the power source (19), and said plurality of LED cluster lamps also being provided with an independent second fail safety device (21*a*) downline towards the power source (19), said independent second fail safety device (21*a*) monitoring the status of one or more of lamps (2, 26, 16,16*a*,16*b*, 16*c*, 16*d*, 16,*e*,16*f*,16*g*,16*h*), the optical feedback travelling on the same signalling cable (20) feeding power supply to the output unit (25), being sensed at the location (1) in the proving unit together with a selection supply voltage, at the supply unit (23) and current flowing out of the selection supply at the station (1) and generating a proving code to provide fail safe output to drive a common relay (48, 15) as ECR wherein this output voltage constitutes a Fail Safe Output and can be used to interface with Solid State Interlocking (SSI).

35. The method as claimed in claim 34, wherein said location (1) is a station or a relay room; a locomotive connected through another medium or a combination thereof.

36. The method claimed in claim 1, wherein at least one more proving is generated for the same output status code (59), at least one more output status code or a combination thereof is generated from the same proving code using the same medium or another medium at the same or another location.

37. The method as claimed in claim 36, wherein the status code of the lamp on signal post (2) is generated by the output unit (25) after it is checked in inherently fail safe manner using under over control means and multiple feedback means (66) in functional priority sequence using optical sensing (64), voltage sensing (67) and current sensing means (65) wherein all functions are ANDed.

38. The method as claimed in the claim 36, wherein, status code is the LED Lamp feedback (59*a*) and proving code is the output generated by the proving unit (24).

39. The method as claimed in claim 36, wherein, the monitoring function inter unit/subunit and/or intra unit/sub unit is in a separate domain from the one or any other monitoring function.

* * * * *